US009546578B2

(12) United States Patent
Takagi et al.

(10) Patent No.: US 9,546,578 B2
(45) Date of Patent: Jan. 17, 2017

(54) VALVE OPERATING SYSTEM FOR ENGINE

(71) Applicant: Mazda Motor Corporation, Aki-gun, Hiroshima (JP)

(72) Inventors: Akitomo Takagi, Hiroshima (JP); Toshimasa Kotani, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 195 days.

(21) Appl. No.: 14/598,213

(22) Filed: Jan. 15, 2015

(65) Prior Publication Data

US 2015/0204219 A1 Jul. 23, 2015

(30) Foreign Application Priority Data

Jan. 21, 2014 (JP) ..... 2014-008868

(51) Int. Cl.
*F01L 1/34* (2006.01)
*F01L 13/00* (2006.01)

(52) U.S. Cl.
CPC .... *F01L 13/0036* (2013.01); *F01L 2013/0052* (2013.01)

(58) Field of Classification Search
CPC ..... F01L 13/0036; F01L 2013/0052; F02M 17/04; F02D 11/04
USPC ..... 123/90.18, 90.17; 261/65
See application file for complete search history.

(56) References Cited

U.S. PATENT DOCUMENTS

| | | | |
|---|---|---|---|
| 8,191,524 | B2 | 6/2012 | Elendt et al. |
| 8,833,319 | B2 | 9/2014 | Kraus |
| 2010/0224154 | A1 | 9/2010 | Elendt et al. |
| 2011/0226205 | A1 | 9/2011 | Kraus |
| 2015/0075467 | A1 | 3/2015 | Kotani et al. |
| 2015/0075468 | A1 | 3/2015 | Takagi et al. |

FOREIGN PATENT DOCUMENTS

| | | | |
|---|---|---|---|
| DE | 102009053116 | A1 | 9/2010 |
| DE | 102010011897 | A1 | 9/2011 |
| DE | 102012210922 | A1 | 1/2014 |
| DE | 102014012774 | A1 | 3/2015 |
| DE | 102014012843 | A1 | 3/2015 |
| JP | 2013083202 | A | 5/2013 |

*Primary Examiner* — Thomas Denion
*Assistant Examiner* — Kelsey Stanek
(74) *Attorney, Agent, or Firm* — Alleman Hall McCoy Russell & Tuttle LLP

(57) ABSTRACT

A valve operating system for an engine is provided. The system includes first and second detent mechanisms for holding a cam element at a first position when the cam element is shifted to one side in camshaft directions, and at a second position when the cam element is shifted to the other side. The detent mechanisms include first and second detent cams and first and second pushing members, respectively. The first detent cam includes first and second grooves and a first top portion. The second detent cam includes third and fourth grooves and a second top portion. The first and second grooves have inclining portions extending from the first top portion toward bottoms thereof, inclining with respect to the camshaft directions, respectively. The third and fourth grooves have inclining portions extending from the second top portion toward bottoms thereof, inclining with respect to the camshaft directions, respectively.

4 Claims, 12 Drawing Sheets

VALVE OPERATING SYSTEM FOR ENGINE

BACKGROUND

The present invention relates to a valve operating system for an engine, which includes a cylindrical cam element and switches, by shifting the cam element in one of two camshaft directions, a cam for opening and closing a valve between two valve-opening-and-closing cams which are provided to the cam element coupled to a camshaft in its rotational direction and fitted to be able to shift (move) in the camshaft directions.

Conventionally, a type of valve operating systems for engines is known, which is provided with a plurality of cams having nose portions in different shapes for each valve, and switches an opening degree and open and close timings of at least one of intake and exhaust valves by selecting the cam for opening and closing the valve among the plurality of cams, according to an operating state of the engine.

For example, US2011/0226205A1 discloses a valve operating system. The valve operating system includes a cam element. An end face cam for shifting the cam element is formed in each end face of the cam element in the camshaft directions. A switching member for engaging with one of the end face cams is provided on each of both sides of the cam element in the camshaft directions. The valve operating system switches the cam for opening and closing the valve by actuating the switching member(s) to engage with the end face cams and shifting the cam element in one of the camshaft directions. Moreover, US2011/0226205A1 discloses that the cam element is held at a predetermined position by a detent mechanism.

Each of the end face cams provided to both end faces of the cam element has a protruding portion, and the protruding portion protrudes in one of the camshaft directions from the corresponding end face of the cam element so as to shift (move) the cam element in the corresponding camshaft direction. The valve operating system provided with such a cam element has a disadvantage in that the length of the cam element in the camshaft directions is long, which causes the length of the entire camshaft to be long, particularly in a multi-cylinder inline engine, because a plurality of cam elements are aligned on either one of a camshaft for intake valves and a camshaft for exhaust valves.

It can be considered to shorten a protruding length of each protruding portion of the end face cam in the corresponding camshaft direction as much as possible as a solution for this disadvantage; however, if the protruding length of the protruding portion is shortened, the cam element cannot be shifted enough, and the cam for opening and closing the valve may not be able to surely be switched.

The present invention is made in view of the above situations and reduces the length of a valve operating system in the camshaft directions as much as possible by shortening protruding lengths of protruding portions of end face cams provided to both end faces of a cam element within an extent that a valve-opening-and-closing cam can be surely switched.

SUMMARY

According to an aspect of the present invention, a valve operating system for an engine is provided. The system shifts a cam element to one side or the other side in camshaft directions to switch a cam for opening and closing a valve between two valve-opening-and-closing cams. The system includes a cylindrical cam element fitted onto a camshaft to be rotatably coupled in a rotational direction of the camshaft and shifted in the camshaft directions, and having two valve-opening-and-closing cams, a first switching member for engaging with a first end face cam provided to one end face of the cam element on one side in the camshaft directions and shifting the cam element to the other side in the camshaft directions, a second switching member for engaging with a second end face cam provided to the other end face of the cam element on the other side in the camshaft directions and shifting the cam element to the one side in the camshaft directions, and a pair of first and second detent mechanisms for holding the cam element at a first position when the cam element is shifted to the one side in the camshaft directions by the second switching member, and holding the cam element at a second position when the cam element is shifted to the other side in the camshaft directions by the first switching member, the second position being on the other side of the first position. The first detent mechanism includes a first detent cam provided to one of the cam element and the camshaft, and a first pushing member pushed against the first detent cam by being elastically biased. The second detent mechanism includes a second detent cam provided to one of the cam element and the camshaft, and a second pushing member pushed against the second detent cam by being elastically biased. The first detent cam includes a first groove and a second groove aligned in the camshaft directions and into which the first pushing member fits, and a first top portion at the boundary between the first and second grooves. The second detent cam includes a third groove and a fourth groove aligned in the camshaft directions and into which the second pushing member fits, and a second top portion at the boundary between the third and fourth grooves. The first and second grooves have inclining portions extending from the first top portion toward bottoms of the first and second grooves while inclining with respect to the camshaft directions, respectively. The third and fourth grooves have inclining portions extending from the second top portion toward bottoms of the third and fourth grooves while inclining with respect to the camshaft directions, respectively. A relative moving distance for the first pushing member fitted into the first groove to cross over the first top portion with respect to the cam element in the camshaft directions is set longer than a relative moving distance for the first pushing member fitted into the second groove to cross over the first top portion with respect to the cam element in the camshaft directions. A relative moving distance for the second pushing member fitted into the third groove to cross over the second top portion with respect to the cam element in the camshaft directions is set longer than a relative moving distance for the second pushing member fitted into the fourth groove to cross over the second top portion with respect to the cam element in the camshaft directions. When the cam element is at the second position, the first pushing member is fitted into the second groove and the second pushing member is fitted into the third groove, and in a case of shifting the cam element from the second position to the one side in the camshaft directions, the first and second detent mechanisms assist this shifting in a manner that the first pushing member relatively moves to the first top portion side along the inclining portion of the second groove, the second pushing member relatively moves to the second top portion side along the inclining portion of the third groove, the first pushing member crosses over the first top portion while the second pushing member still moves along the second top portion, and the first pushing member pushes the inclining portion of the first groove after crossing over the first top portion. When the cam element is at the first position, the first pushing member is fitted into the first groove and the second pushing member is fitted into the fourth groove, and in a case of shifting the cam element from the first position to the other side in the camshaft directions, the first and second detent mechanisms assist this shifting in a manner that the first pushing member relatively moves to the first top portion side along the inclining portion of the first groove, the second pushing member relatively moves to the second top portion side along the inclining portion of the fourth groove, the second pushing member crosses over the second top portion while the first pushing member still moves along the first top portion, and the second pushing member pushes the inclining portion of the third groove after crossing over the second top portion.

With the above configuration, in the case of shifting the cam element from the second position to the one side in the camshaft directions, this shifting can be assisted in the manner that the first pushing member crosses over the first top portion while the second pushing member still moves along the second top portion, and the first pushing member pushes the inclining portion of the first groove after crossing over the first top portion. In other words, the first pushing member assists the shifting of the cam element to the one side in the early stage before the second pushing member crosses over the second top portion. After crossing over the second top portion, even if the cam element is not pushed to the one side by the second switching member, the cam element is positioned at the first position by the assist. Here, while the second pushing member moves along the second top portion, whether the second pushing member acts to resist or contribute in assisting the shifting of the cam element to the one side is not certain. Even assuming that the second pushing member acts to resist, the resisting force of the second pushing member is much smaller than the case where the second pushing member relatively moves to the second top portion side along the inclining portion of the third groove, and the assisting force of the first pushing member is larger than the resisting force. Therefore, the cam element shifts to the one side by the assisting force. Moreover, also for the case of shifting the cam element from the first position to the other side in the camshaft directions, the second pushing member assists the shifting of the cam element to the other side in the early stage before the first pushing member crosses over the first top portion. After crossing over the first top portion, even if the cam element is not pushed to the other side by the first switching member, the cam element is positioned at the second position by the assist. Therefore, the cam for opening and closing the valve can surely be switched and the pushing amount of the cam element by the first and second switching members can be reduced, in other words, protruding lengths of protruding portions of the first and second end face cams can be shortened, and the length of the cam element in the camshaft directions can be shortened.

The first and second detent cams are preferably formed symmetric to each other with respect to a plane passing through a center between the first and second top portions in the camshaft directions and extending perpendicular to the camshaft directions.

Thus, the first and second detent cams can be formed easily, the timing of the crossing over and the assisting force are the same in both of the cases of shifting the cam element to the one side and to the other side, and the cam for opening and closing the valve can be switched stably. Moreover, the first and second pushing members can share a component.

The first switching member preferably projects to an actuated position at which the first switching member engages with the first end face cam so as to shift the cam element to the other side in the camshaft directions, and preferably retreats to a non-actuated position at which the first switching member is retreated from the actuated position. The second switching member preferably projects to an actuated position at which the second switching member engages with the second end face cam so as to shift the cam element to the one side in the camshaft directions, and preferably retreats to a non-actuated position at which the second switching member is retreated from the actuated position. The first and second end face cams of the cam element are preferably formed such that protrusion tip positions of the first and second end face cams are different in phase in the rotational direction and a longest distance between cam surfaces of the first and second end face cams in the camshaft directions in the same rotational phase is shorter than a distance between the first and second switching members at the respective actuated positions in the camshaft directions.

In this manner, in any phase, the distance between cam surfaces of the first and second end face cams in the camshaft directions is never longer than the distance between the first and second switching members in the camshaft directions. Thus, even if both of the first and second switching members are at the respective actuated positions due to a failure or the like, a situation where the cam element becomes unrotatable by getting stuck between the first and second switching members at both sides of the cam element, in other words, a situation where the rotation of the camshaft is interrupted, does not occur.

DETAILED DESCRIPTION OF EMBODIMENT

Hereinafter, one embodiment of the present invention is described with reference to the appended drawings. In this embodiment, an exhaust side valve operating system for a four-cylinder four-valve DOHC engine is used as an example.

Figure 1:
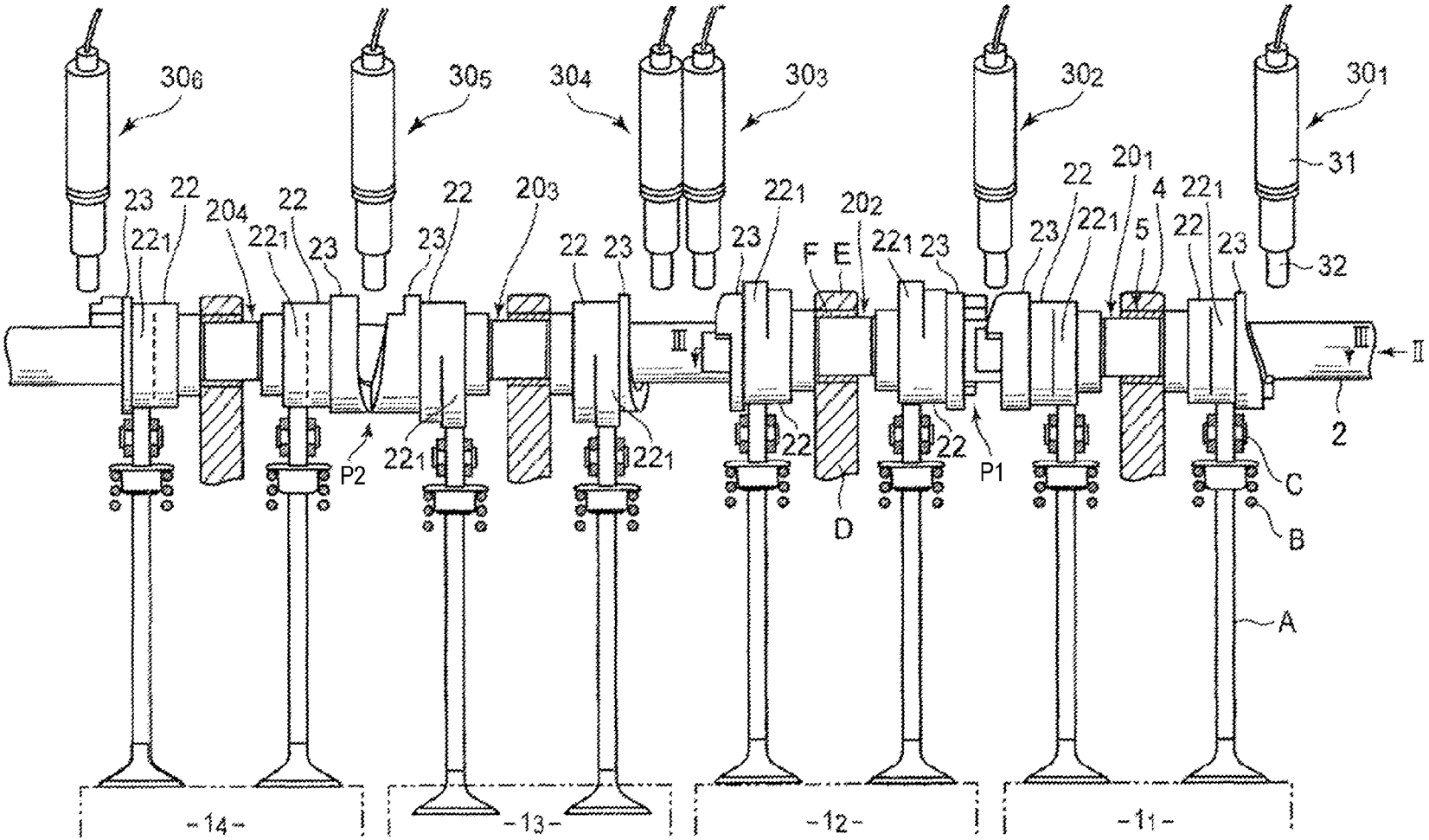
FIG. 1 is a side view schematically illustrating a configuration of an exhaust side valve operating system for an engine according to one embodiment of the present invention.

FIG. 1 depicts a configuration of the exhaust side valve operating system according to this embodiment of the present invention. The valve operating system, in a cylinder head (not illustrated), includes two exhaust valves A for each of first to fourth cylinders $\mathbf{1}_1$ to $\mathbf{1}_4$, for a total of eight exhaust valves A, and return springs B for biasing the exhaust valves A in a closing direction. The valve operating system also includes, in an upper part of the cylinder head, a camshaft 2 for opening the exhaust valves A against the respective biasing forces of the return springs B via rocker arms C. Note that, in the valve operating system, in a row of the cylinders, the first cylinder $\mathbf{1}_1$ side (right side of FIG. 1) is referred to as forward, and the fourth cylinder $\mathbf{1}_4$ side (left side of FIG. 1) is referred to as rearward.

The camshaft 2 is rotatably supported by bearings F including vertical wall parts D provided at central positions of the respective cylinders $\mathbf{1}_1$ to $\mathbf{1}_4$ of the cylinder head, and cap members E attached on the respective vertical wall parts D. The camshaft 2 is rotatably driven by a crankshaft (not illustrated) via a chain.

First to fourth cylindrical cam elements $\mathbf{20}_1$ to $\mathbf{20}_4$ are spline-fitted onto the camshaft 2. Thus, the first to fourth cam elements $\mathbf{20}_1$ to $\mathbf{20}_4$ are coupled to the camshaft 2 in its rotational direction (integrally rotate with the camshaft 2) and fitted onto the camshaft 2 to shift (move) in camshaft extending directions (may simply be referred to as the camshaft directions). A part of the camshaft 2 where each of the cam elements $\mathbf{20}_1$ to $\mathbf{20}_4$ is spline-fitted, corresponds to a part of an inner circumferential face of the corresponding cam element ($\mathbf{20}_1$ to $\mathbf{20}_4$) between a first detent cam 45 and a second detent cam 46 (described later). The cam elements $\mathbf{20}_1$ to $\mathbf{20}_4$ are arranged substantially in a line on the camshaft 2 in the camshaft directions to correspond to the respective cylinders $\mathbf{1}_1$ to $\mathbf{1}_4$.

First to sixth electromagnetic switching devices $\mathbf{30}_1$ to $\mathbf{30}_6$ for shifting the cam elements $\mathbf{20}_1$ to $\mathbf{20}_4$ on the camshaft 2 by respective predetermined strokes are provided in the valve operating system. Specifically, the first switching device $\mathbf{30}_1$ is disposed at a front position of the first cylinder $\mathbf{1}_1$ (forward of the first cam element $\mathbf{20}_1$), the second switching device $\mathbf{30}_2$ is disposed at a position between the first and second cylinders $\mathbf{1}_1$ and $\mathbf{1}_2$ (between the first and second cam elements $\mathbf{20}_1$ and $\mathbf{20}_2$), the third switching device $\mathbf{30}_3$ is disposed at a position between the second and third cylinders 12 and 13 (between the second and third cam elements $\mathbf{20}_2$ and $\mathbf{20}_3$), the fourth switching device $\mathbf{30}_4$ is disposed at a position adjacently behind the third switching device $\mathbf{30}_3$, the fifth switching device $\mathbf{30}_5$ is disposed at a position between the third and fourth cylinders $\mathbf{1}_3$ and $\mathbf{1}_4$ (between the third and fourth cam elements $\mathbf{20}_3$ and $\mathbf{20}_4$), and the sixth switching device $\mathbf{30}_6$ is disposed at a rear position of the fourth cylinder $\mathbf{1}_4$ (rearward of the fourth cam element $\mathbf{20}_4$).

Figure 2:
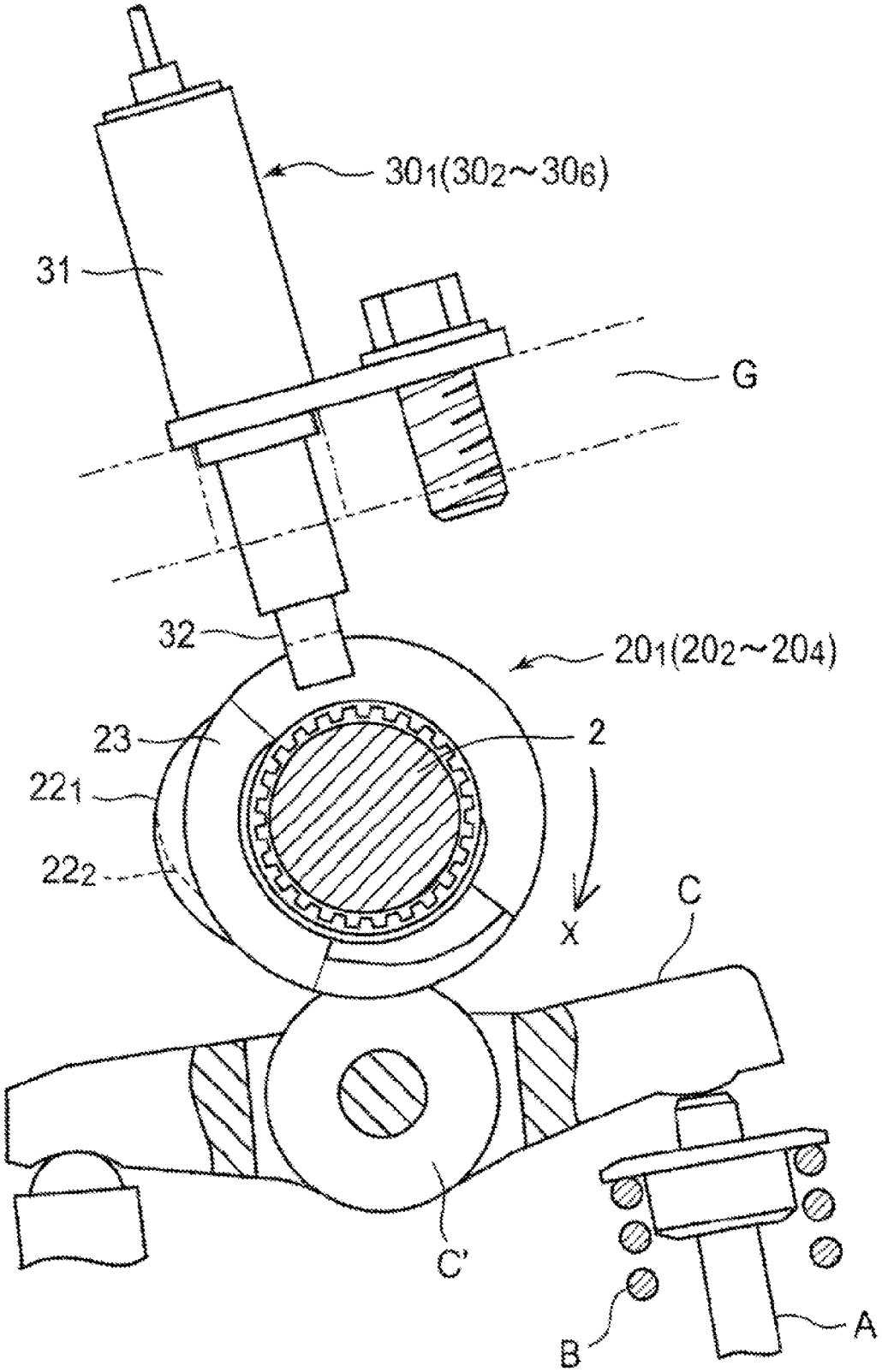
FIG. 2 is a plan view of the exhaust side valve operating system taken in a II-direction in FIG. 1.

As illustrated in FIG. 2, each of the first to sixth switching devices $\mathbf{30}_1$ to $\mathbf{30}_6$ is arranged such that a switching member 32 (described later) thereof is oriented toward an axial center of the camshaft 2 from an opposite side to a cam follower C' of a rocker arm C with respect to the camshaft 2 therebetween. In this embodiment, the switching devices $\mathbf{30}_1$ to $\mathbf{30}_6$ are attached to a cylinder head cover G covering the camshaft 2 and the cam elements $\mathbf{20}_1$ to $\mathbf{20}_4$ from above.

Each of the switching devices $\mathbf{30}_1$ to $\mathbf{30}_6$ includes a main body 31 provided therein with an electromagnetic actuator, and a pin-like switching member 32 having a substantially circular shape in cross section and for protruding downward from the main body 31 toward the camshaft 2 when power is distributed to the electromagnetic actuator. When the power is not distributed to the electromagnetic actuator, as indicated by the dashed line in FIG. 2, the switching member 32 is held at a non-actuated position which is an upper position, by a permanent magnet provided in the main body 31. On the other hand, when the power is distributed to the electromagnetic actuator, as indicated by the solid line in FIG. 2, the switching member 32 protrudes downward against the permanent magnet, to project to an actuated position. When the switching member 32 projects to the actuated position, it projects to a position adjacent, in the camshaft directions, to one of end face cams 23 (described later) provided to front and rear end faces of the corresponding cam element (hereinafter, may simply be referred to as "the front end face cam" and "the rear end face cam"), and the switching member 32 shifts the cam element either rearward or forward in the camshaft directions by engaging with one of the front and rear end face cams 23 of the cam element.

When the switching member 32 of the first switching device $\mathbf{30}_1$ is at the actuated position, it shifts the first cam element $\mathbf{20}_1$ rearward in the camshaft directions. When the switching member 32 of the second switching device $\mathbf{30}_2$ is at the actuated position, it shifts the first cam element $\mathbf{20}_1$ forward in the camshaft directions and shifts the second cam element $\mathbf{20}_2$ rearward in the camshaft directions. When the switching member 32 of the third switching device $\mathbf{30}_3$ is at the actuated position, it shifts the second cam element $\mathbf{20}_2$ forward in the camshaft directions. When the switching member 32 of the fourth switching device $\mathbf{30}_4$ is at the actuated position, it shifts the third cam element $\mathbf{20}_3$ rearward in the camshaft directions. When the switching member 32 of the fifth switching device $\mathbf{30}_5$ is at the actuated position, it shifts the third cam element $\mathbf{20}_3$ forward in the camshaft directions and shifts the fourth cam element $\mathbf{20}_4$ rearward in the camshaft directions. When the switching member 32 of the sixth switching device $\mathbf{30}_6$ is at the actuated position, it shifts the fourth cam element $\mathbf{20}_4$ forward in the camshaft directions.

The power distribution to each of the switching devices $\mathbf{30}_1$ to $\mathbf{30}_6$ (electromagnetic actuators) is performed through a power distribution instruction to the corresponding switching device ($\mathbf{30}_1$ to $\mathbf{30}_6$) from a computer (not illustrated) at a timing corresponding to a predetermined engine rotational angle, based on a detection signal from an engine rotational angle sensor (not illustrated).

Figure 3:
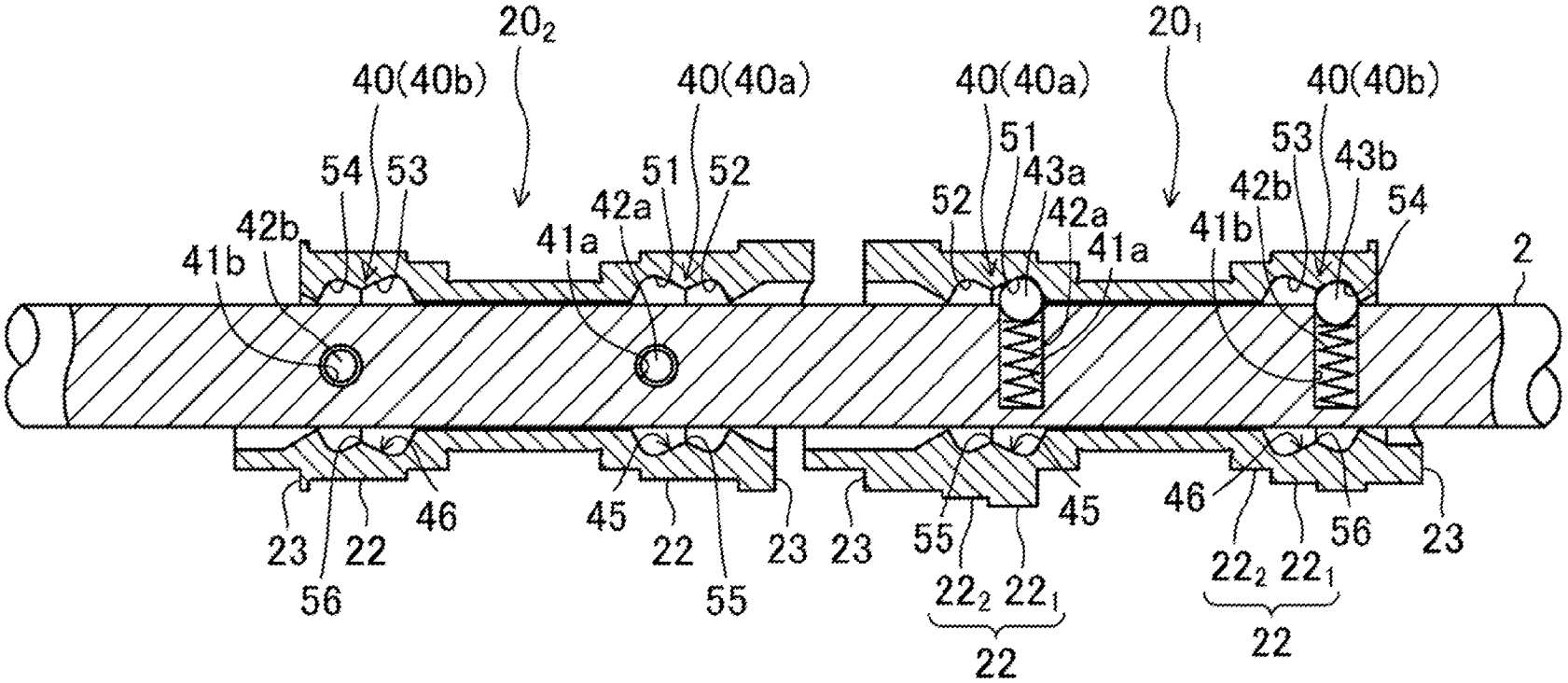
FIG. 3 is an enlarged cross-sectional view taken along a line in FIG. 1.

Moreover, the valve operating system includes detent mechanisms 40 provided at both sides of the part in the camshaft directions where each of the cam elements $\mathbf{20}_1$ to $\mathbf{20}_4$ is spline-fitted onto the camshaft 2 as illustrated in FIG. 3 by using the first and second cam elements $\mathbf{20}_1$ and $\mathbf{20}_2$ as an example, in order to hold the cam elements $\mathbf{20}_1$ to $\mathbf{20}_4$ at two predetermined positions (first and second positions) after the shifting of the cam elements $\mathbf{20}_1$ to $\mathbf{20}_4$ in the camshaft directions by the switching devices $\mathbf{30}_1$ to $\mathbf{30}_6$. The detent mechanisms 40 are provided as a pair for each cam element. Hereinafter, when discriminating between the pair of detent mechanisms 40, one of them is referred to as the first detent mechanism 40*a* and the other one is referred to as the second detent mechanism 40*b*, and when they are not discriminated, each of them is simply referred to as the detent mechanism 40.

The first detent mechanism 40*a* includes the first detent cam 45 provided in the inner circumferential face of each of the cam elements $\mathbf{20}_1$ to $\mathbf{20}_4$, and a first detent ball 43*a* as a first pressing member that is pressed by being elastically biased to the first detent cam 45. A part of the first detent ball 43*a* (camshaft 2 side part) is within a first hole 41*a* formed in the camshaft 2, and a first spring 42*a* configured with a coil spring is accommodated deeper in the first hole 41*a* than the part of the first detent ball 43*a*. The first detent ball 43*a* is pressed against the first detent cam 45 by the first spring 42*a*.

Moreover, the second detent mechanism 40*b* includes the second detent cam 46 provided in the inner circumferential face of each of the cam elements $\mathbf{20}_1$ to $\mathbf{20}_4$, and a second detent ball 43*b* as a second pressing member that is pressed by being elastically biased to the second detent cam 46. A part of the second detent ball 43*b* (camshaft 2 side part) is within a second hole 41*b* formed in the camshaft 2, and a second spring 42*b* configured with a coil spring is accommodated deeper in the second hole 41*b* than the part of the second detent ball 43*b*. The second detent ball 43*b* is pressed against the second detent cam 46 by the second spring 42*b*.

The first detent cam 45 is formed by a first groove 51 and a second groove 52 adjacent to each other in the camshaft directions and for engaging with the first detent ball 43*a* by fitting it thereinto, and a first top portion 55 positioned at a boundary between the grooves 51 and 52. The second detent cam 46 is formed by a third groove 53 and a fourth groove 54 adjacent to each other in the camshaft directions and for engaging with the second detent ball 43*b* by fitting it thereinto, and a second top portion 56 positioned at a boundary between the grooves 53 and 54. The first to fourth grooves 51 to 54 are formed over the entire circumference of the inner circumferential face of each of the cam elements $\mathbf{20}_1$ to $\mathbf{20}_4$.

In the first and third cam elements $\mathbf{20}_1$ and $\mathbf{20}_3$, the second detent mechanism 40*b* is positioned forward of the first detent mechanism 40*a* in the camshaft directions, and in the second and fourth cam elements $\mathbf{20}_2$ and $\mathbf{20}_4$, the second detent mechanism 40*b* is positioned rearward of the first detent mechanism 40*a* in the camshaft directions. Moreover, in the first and third cam elements $\mathbf{20}_1$ and $\mathbf{20}_3$, the second groove 52 is positioned rearward of the first groove 51 via the first top portion 55 in the camshaft directions, and in the second and fourth cam elements $\mathbf{20}_2$ and $\mathbf{20}_4$, the second groove 52 is positioned forward of the first groove 51 via the first top portion 55 in the camshaft directions. Further, in the first and third cam elements $\mathbf{20}_1$ and $\mathbf{20}_3$, the fourth groove 54 is positioned forward of the third groove 53 via the second top portion 56 in the camshaft directions, and in the second and fourth cam elements $\mathbf{20}_2$ and $\mathbf{20}_4$, the fourth groove 54 is positioned rearward of the third groove 53 via the second top portion 56 in the camshaft directions. Thus, the first and third cam elements $\mathbf{20}_1$ and $\mathbf{20}_3$ have the front-and-rear structure opposite to that of the second and fourth cam elements $\mathbf{20}_2$ and $\mathbf{20}_4$.

When the first detent ball 43*a* is fitted into the first groove 51 and the second detent ball 43*b* is fitted into the fourth groove 54, the corresponding cam element ($\mathbf{20}_1$ to $\mathbf{20}_4$) is held at the first position illustrated in FIGS. 1 and 3. On the other hand, when the first detent ball 43*a* is fitted into the second groove 52 and the second detent ball 43*b* is fitted into the third groove 53, the corresponding cam element ($\mathbf{20}_1$ to $\mathbf{20}_4$) is held at the second position illustrated in FIG. 4.

Here, as illustrated in FIG. 1, when all of the first to fourth cam elements $\mathbf{20}_1$ to $\mathbf{20}_4$ are at the respective first positions, the first cam element $\mathbf{20}_1$ is positioned at a rearward position, the second cam element $\mathbf{20}_2$ is positioned at a forward position, the third cam element $\mathbf{20}_3$ is positioned at a rearward position, and the fourth cam element $\mathbf{20}_4$ is positioned at a forward position. Therefore, when all of the first to fourth cam elements $\mathbf{20}_1$ to $\mathbf{20}_4$ are at the respective first positions, one of end faces of the first cam element $\mathbf{20}_1$ on the closer side to the second cam element $\mathbf{20}_2$ and one of end faces of the second cam element $\mathbf{20}_2$ on the closer side to the first cam element $\mathbf{20}_1$ (hereinafter, such end faces are simply referred to as "opposing end faces") are close to each other, opposing end faces of the second and third cam elements $\mathbf{20}_2$ and $\mathbf{20}_3$ are far from each other, and opposing end faces of the third and fourth cam elements $\mathbf{20}_3$ and $\mathbf{20}_4$ are close to each other.

Figure 4:
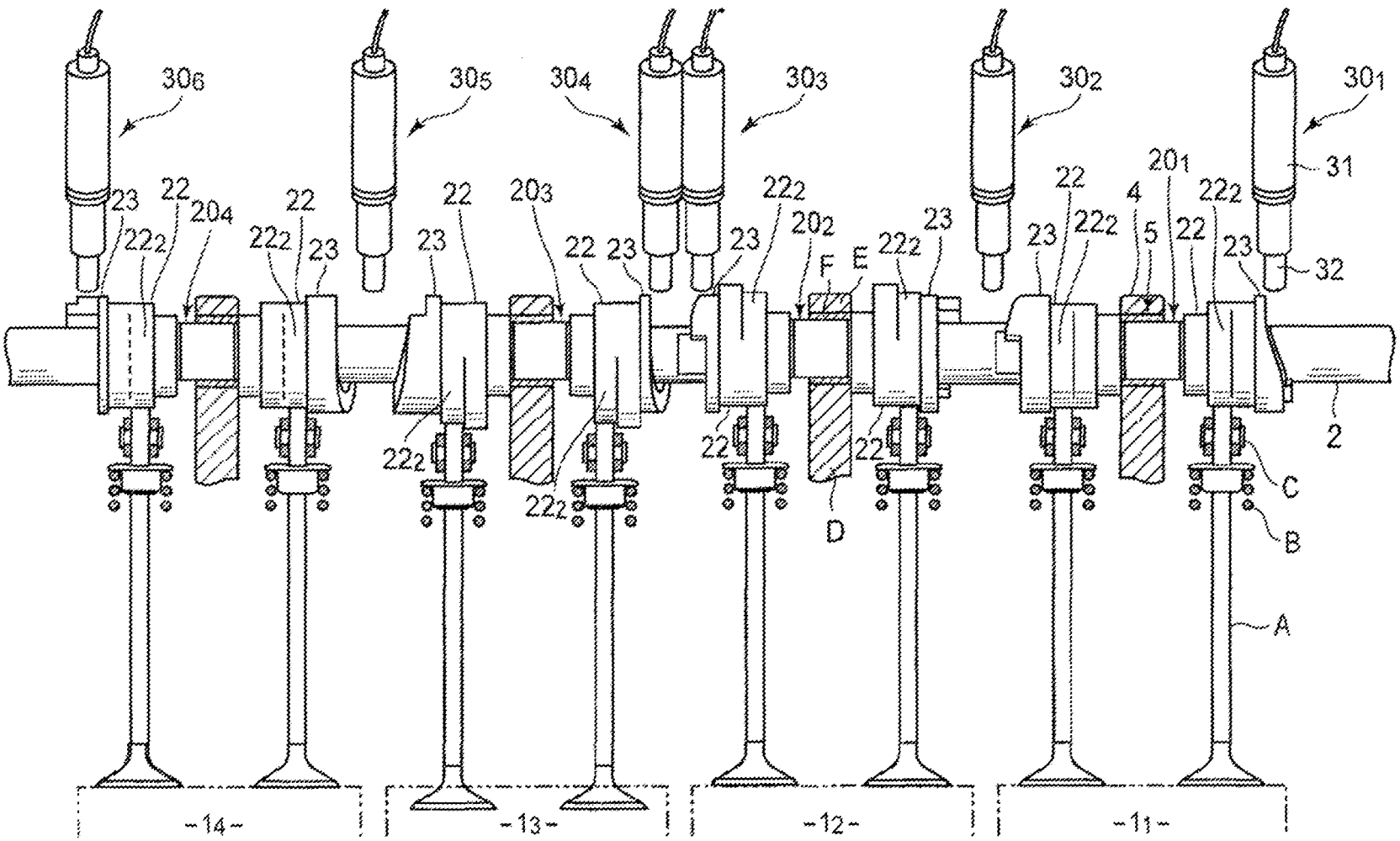
FIG. 4 is a view corresponding to FIG. 1, illustrating the exhaust side valve operating system in a state where cams for operating and closing valves are switched from the state in FIG. 1.

Moreover, as illustrated in FIG. 4, when all of the first to fourth cam elements $\mathbf{20}_1$ to $\mathbf{20}_4$ are at the respective second positions, the first cam element $\mathbf{20}_1$ is positioned at the forward position, the second cam element $\mathbf{20}_2$ is positioned at the rearward position, the third cam element $\mathbf{20}_3$ is positioned at the forward position, and the fourth cam element $\mathbf{20}_4$ is positioned at the rearward position. Here, when all of the first to fourth cam elements $\mathbf{20}_1$ to $\mathbf{20}_4$ are at the respective second positions, the opposing end faces of the first and second cam elements $\mathbf{20}_1$ and $\mathbf{20}_2$ are far from each other, the opposing end faces of the second and third cam elements $\mathbf{20}_2$ and $\mathbf{20}_3$ are close to each other, and the opposing end faces of the third and fourth cam elements $\mathbf{20}_3$ and $\mathbf{20}_4$ are far from each other.

Thus, the first and third cam elements $\mathbf{20}_1$ and $\mathbf{20}_3$ are positioned at the first positions when being shifted leftward in FIGS. 1, 3, and 4 (rearward), and the first and third cam elements $\mathbf{20}_1$ and $\mathbf{20}_3$ are positioned at the second positions when being shifted rightward in FIGS. 1, 3, and 4 (forward), whereas the second and fourth cam elements $\mathbf{20}_2$ and $\mathbf{20}_4$ are positioned at the first positions when being shifted rightward in FIGS. 1, 3, and 4 (forward), and the second and fourth cam elements $\mathbf{20}_2$ and $\mathbf{20}_4$ are positioned at the second positions when being shifted leftward in FIGS. 1, 3, and 4 (rearward). Therefore, regarding the first and third cam elements $\mathbf{20}_1$ and $\mathbf{20}_3$, leftward in FIGS. 1, 3, and 4 (rearward) may also be referred to as one side in the camshaft directions and rightward in FIGS. 1, 3, and 4 (forward) may also be referred to as the other side in the camshaft directions. On the other hand, regarding the second and fourth cam elements $\mathbf{20}_2$ and $\mathbf{20}_4$, rightward in FIGS. 1, 3, and 4 (forward) may also be referred to as one side in the camshaft directions and leftward in FIGS. 1, 3, and 4 (rearward) may also be referred to as the other side in the camshaft directions.

Moreover, the switching member 32 of the second switching device $\mathbf{30}_2$ may also be referred to as the first switching member, which shifts the first cam element $\mathbf{20}_1$ to the other side in the camshaft directions, and the switching member 32 of the first switching device $\mathbf{30}_1$ may also be referred to as the second switching member, which shifts the first cam element $\mathbf{20}_1$ to the one side in the camshaft directions. Moreover, the switching member 32 of the second switching device $\mathbf{30}_2$ may also function as the first switching member, which shifts the second cam element $\mathbf{20}_2$ to the other side in the camshaft directions, and the switching member 32 of the third switching device $\mathbf{30}_3$ may also be referred to as the second switching member, which shifts the second cam element $\mathbf{20}_2$ to the one side in the camshaft directions. Further, the switching member 32 of the fifth switching device $\mathbf{30}_5$ may also be referred to as the first switching member, which shifts the third cam element $\mathbf{20}_3$ to the other side in the camshaft directions, and the switching member 32 of the fourth switching device $\mathbf{30}_4$ may also be referred to as the second switching member, which shifts the third cam element $\mathbf{20}_3$ to the one side in the camshaft directions. Furthermore, the switching member 32 of the fifth switching device 30*s* may also function as the first switching member, which shifts the fourth cam element $\mathbf{20}_4$ to the other side in the camshaft directions, and the switching member 32 of the sixth switching device $\mathbf{30}_6$ may also be referred to as the second switching member, which shifts the fourth cam element $\mathbf{20}_4$ to the one side in the camshaft directions.

Figure 5:
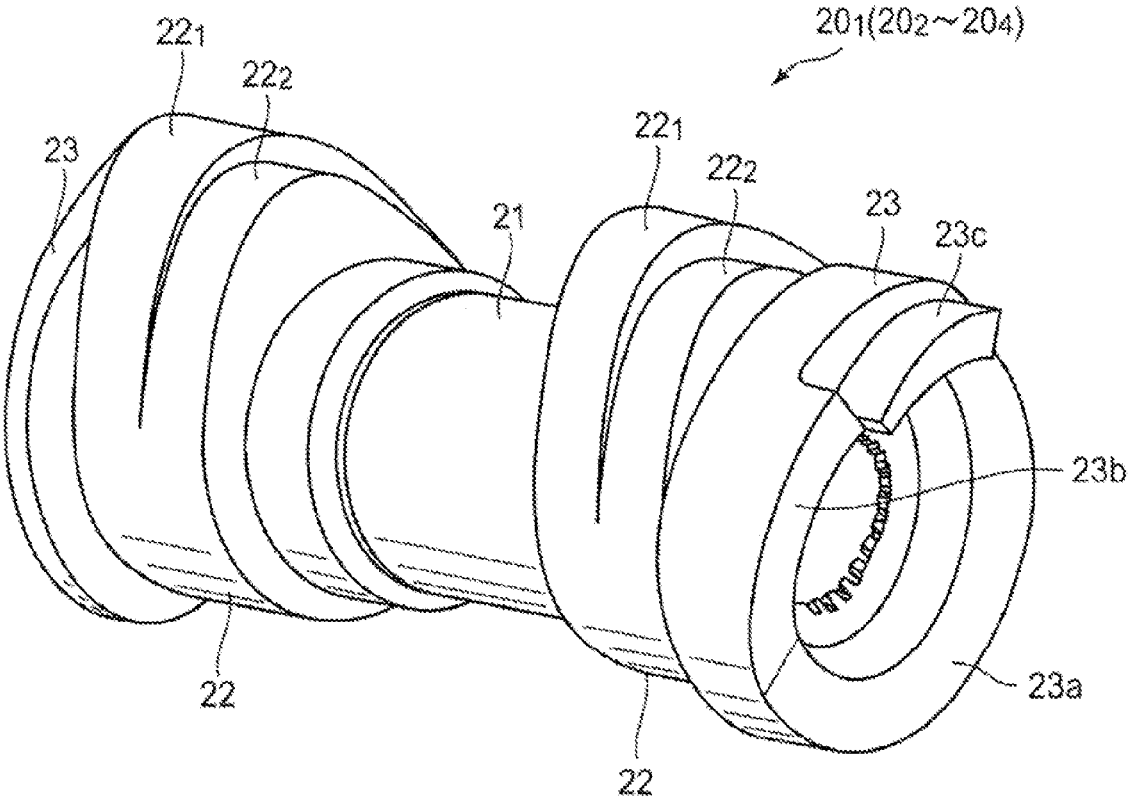
FIG. 5 is a perspective view of a cam element.

Next, the configuration of the cam elements $\mathbf{20}_1$ to $\mathbf{20}_4$ is described in further detail by taking the first and second cam elements $\mathbf{20}_1$ and $\mathbf{20}_2$ as an example, with reference to FIGS. 5 to 9. An outer circumferential face of an intermediate part of the cylindrical cam element $\mathbf{20}_1$ ($\mathbf{20}_2$ to $\mathbf{20}_4$) in cylinder axial directions (matching with the camshaft directions) serves as a journal face 21 supported by the bearing F, and operating parts 22 for opening and closing the two exhaust valves A of the corresponding cylinder are provided at both sides of the journal face 21 in the cylinder axial directions (both front and rear sides in the camshaft directions). As illustrated in FIG. 5, each operating part 22 is provided with a first cam $\mathbf{22}_1$ used for, for example, a low engine speed and having a low lift and a second cam $\mathbf{22}_2$ used for, for example, a high engine speed and having a high lift. The first and second cams $\mathbf{22}_1$ and $\mathbf{22}_2$ are disposed adjacent to each other.

Figure 7A:
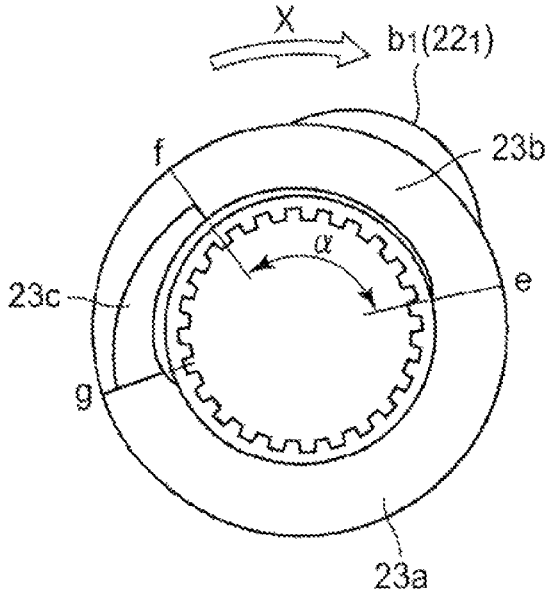
FIG. 7A is a plan view of the cam element of the first cylinder.
Figure 7B:
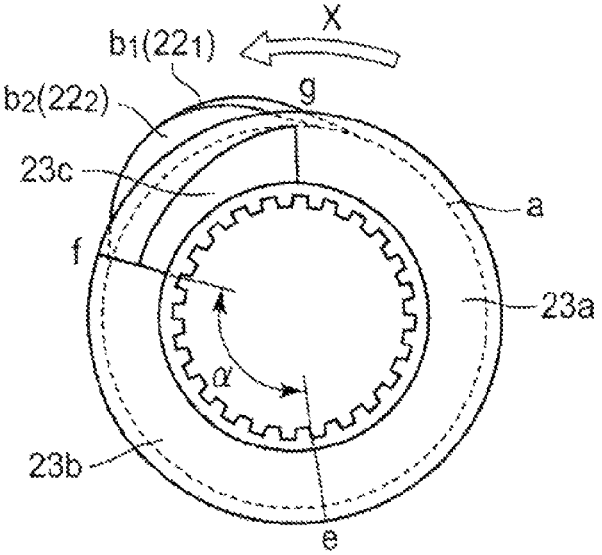
FIG. 7B is a rear view of the cam element of the first cylinder.

As illustrated in FIG. 7B, the first and second cams $\mathbf{22}_1$ and $\mathbf{22}_2$ respectively have common base circles "a" and nose portions $b_1$ and $b_2$ with different lifts and slightly different phases on the base circles a. Further, the first and second cams $\mathbf{22}_1$ and $\mathbf{22}_2$ are provided to each of the operating parts 22 such that the arrangement thereof in the front-and-rear directions and the phases of the nose portions $b_1$ and $b_2$ are uniformed between the two operating parts 22. Note that having the common base circles a means that the base circles a of the first and second cams $\mathbf{22}_1$ and $\mathbf{22}_2$ have the same diameter.

In each of the first and third cam elements $\mathbf{20}_1$ and $\mathbf{20}_3$, the first cam $\mathbf{22}_1$ is disposed forward of the second cam $\mathbf{22}_2$, and in each of the second and fourth cam elements $\mathbf{20}_2$ and $\mathbf{20}_4$, the second cam $\mathbf{22}_2$ is disposed forward of the first cam $\mathbf{22}_1$.

Further, when the cam elements $\mathbf{20}_1$ to $\mathbf{20}_4$ are held at the respective first positions on the camshaft 2 by the detent mechanisms 40, in each of the cam elements $\mathbf{20}_1$ to $\mathbf{20}_4$, the positions of the two first cams $\mathbf{22}_1$ correspond to (are located right above) the two cam followers C' of the rocker arms C of the corresponding cylinder among the cylinders $\mathbf{1}_1$ to $\mathbf{1}_4$ (see FIG. 1), and when the cam elements $\mathbf{20}_1$ to $\mathbf{20}_4$ are positioned at the respective second positions on the camshaft 2, in each of the cam elements $\mathbf{20}_1$ to $\mathbf{20}_4$, the positions of the two second cams $\mathbf{22}_2$ correspond to (are located right above) the two cam followers C' of the rocker arms C of the corresponding cylinder among the cylinders $\mathbf{1}_1$ to $\mathbf{1}_4$ (see FIG. 4). Thus, the cam for opening and closing the valve is switched between the first and second cams $\mathbf{22}_1$ and $\mathbf{22}_2$ by shifting the cam elements $\mathbf{20}_1$ to $\mathbf{20}_4$ either forward or rearward in the camshaft directions.

Here, in the engine of this embodiment, the combustion order of the cylinders is the third cylinder $\mathbf{1}_3$, the fourth cylinder $\mathbf{1}_4$, the second cylinder $\mathbf{1}_2$, and then the first cylinder $\mathbf{1}_1$. The first to fourth cam elements $\mathbf{20}_1$ to $\mathbf{20}_4$ are offset in phase and are spline-fitted onto the camshaft 2, so that the positions of the nose portions $b_1$ of the first cams $\mathbf{22}_1$ or the nose portions $b_2$ of the second cams $\mathbf{22}_2$ of each of the cam elements $\mathbf{20}_1$ to $\mathbf{20}_4$ correspond to the cam followers C' in the combustion order every time the camshaft 2 rotates by 90°.

Further, each of the cam elements $\mathbf{20}_1$ to $\mathbf{20}_4$ is provided with the end face cams 23 at its front and rear end faces. The rear end face cams 23 of the first and third cam elements $\mathbf{20}_1$ and $\mathbf{20}_3$ may also be referred to as the first end face cams, and the front end face cams 23 of the first and third cam elements $\mathbf{20}_1$ and $\mathbf{20}_3$ may also be referred to as the second end face cams. Moreover, the front end face cams 23 of the second and fourth cam elements $\mathbf{20}_2$ and $\mathbf{20}_4$ may also be referred to as the first end face cams, and the rear end face cams 23 of the second and fourth cam elements $\mathbf{20}_2$ and $\mathbf{20}_4$ may also be referred to as the second end face cams.

Figure 6:
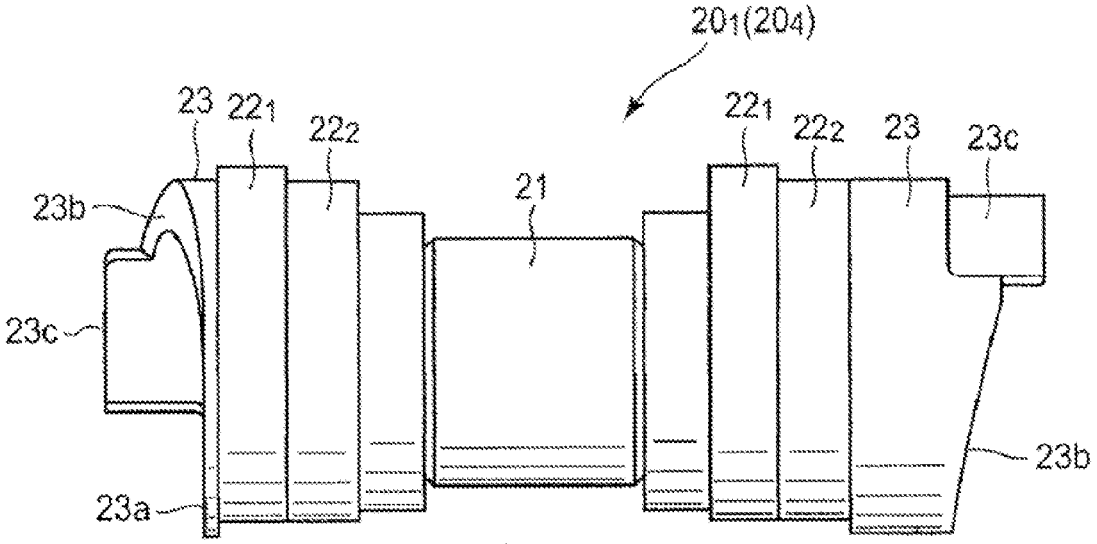
FIG. 6 is a side view of a cam element of a first cylinder (or fourth cylinder).
Figure 8:
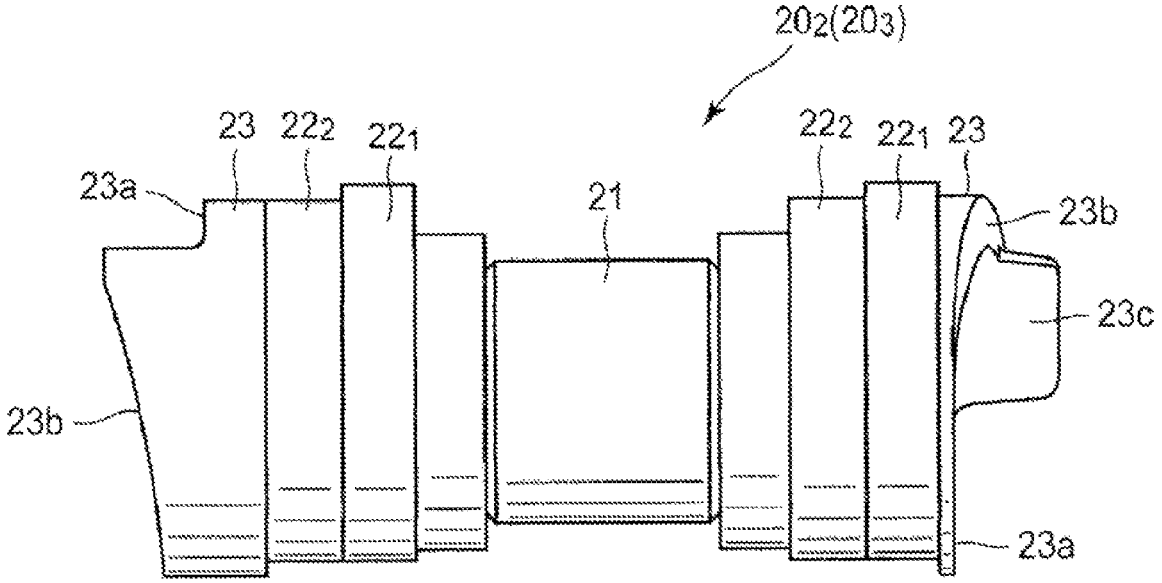
FIG. 8 is a side view of a cam element of a second cylinder (or third cylinder).
Figure 9A:
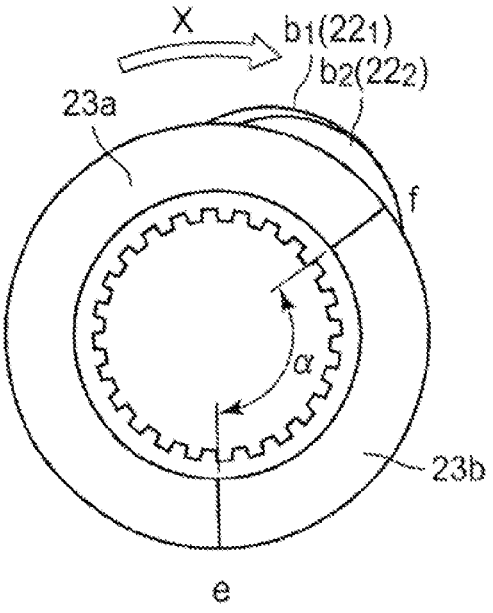
FIG. 9A is a plan view of the cam element of the second cylinder.
Figure 9B:
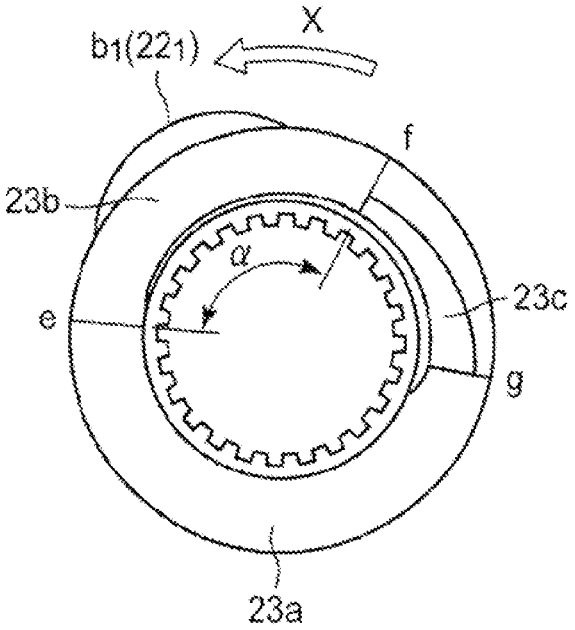
FIG. 9B is a rear view of the cam element of the second cylinder.

As illustrated in FIGS. 6 and 8, the front and rear end face cams 23 of each of the cam elements $\mathbf{20}_1$ to $\mathbf{20}_4$ have protruding portions 23*b* protruding forward and rearward respectively in the camshaft directions from reference surfaces 23*a*. Note that, in FIG. 6, the left side corresponds to the front side of the first cam element $\mathbf{20}_1$ and the rear side of the fourth cam element $\mathbf{20}_4$, and the right side corresponds to the rear side of the first cam element $\mathbf{20}_1$ and the front side of the fourth cam element $\mathbf{20}_4$. Moreover, in FIG. 8, the left side corresponds to the front side of the second cam element $\mathbf{20}_2$ and the rear side of the third cam element $\mathbf{20}_3$, and the right side corresponds to the rear side of the second cam element $\mathbf{20}_2$ and the front side of the third cam element $\mathbf{20}_3$.

As illustrated in FIGS. 7 and 9, within a predetermined phase range $\alpha$ (e.g., 120°) from a protrusion start position "e" to a protrusion end position "f", the amount that each protruding portion 23*b* protrudes in the corresponding camshaft direction gradually increases from the reference surface 23*a* (zero protruding amount) with respect to a rotational direction X and returns to the reference surface 23*a* (zero protruding amount) at either one of the protrusion end position f and a slope end position "g" described later.

As it is obvious by comparison between FIGS. 7A and 7B (or FIGS. 9A and 9B), each of the cam elements $\mathbf{20}_1$ to $\mathbf{20}_4$ is arranged such that the protrusion end positions f of the front and rear end face cams 23 thereof are different in phase from each other. In other words, the front and rear end face cams 23 of each of the cam elements $\mathbf{20}_1$ to $\mathbf{20}_4$ are formed such that their protrusion tip positions are different in phase in the rotational direction.

Moreover, the front and rear end face cams 23 of each of the cam elements $\mathbf{20}_1$ to $\mathbf{20}_4$ are formed such that a longest length Lmax of a distance between cam surfaces of the end face cams 23 in the camshaft directions in the same phase is shorter than a distance Lpin between the switching members 32 at the respective actuated positions in the camshaft directions (the switching members 32 engaging with cam surfaces of the end face cams 23). In other words, in any phase, the distance in the camshaft directions between the cam surfaces of the front and rear end face cams 23 is never farther than the distance Lpin in the camshaft directions between the switching members 32.

Figure 10:
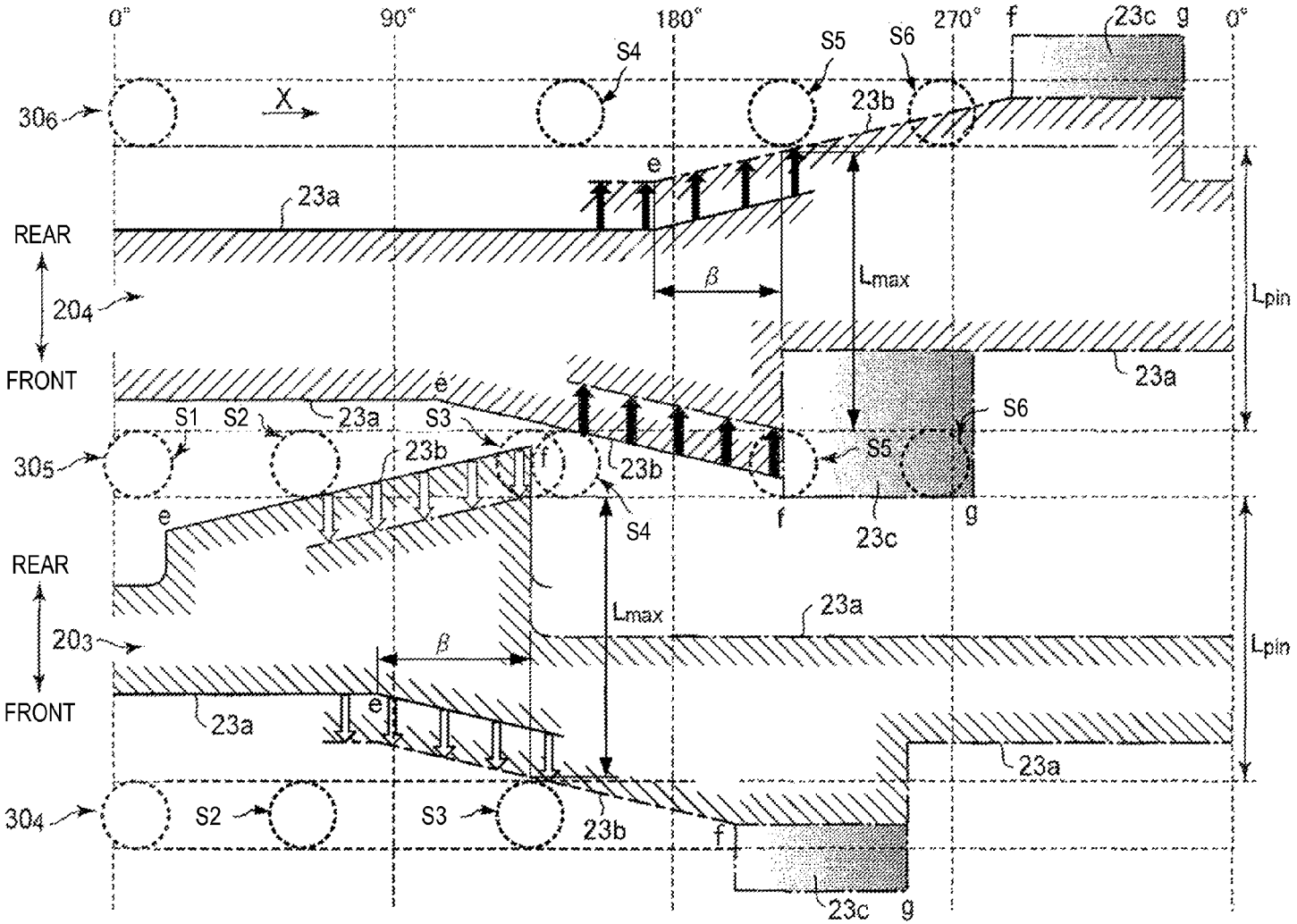
FIG. 10 is an enlarged developed view of a main part along circumferences of the end cams, illustrating a positional relationship among the end face cams and switching members in separating the cam elements of the third and fourth cylinders from each other.
Figure 11:
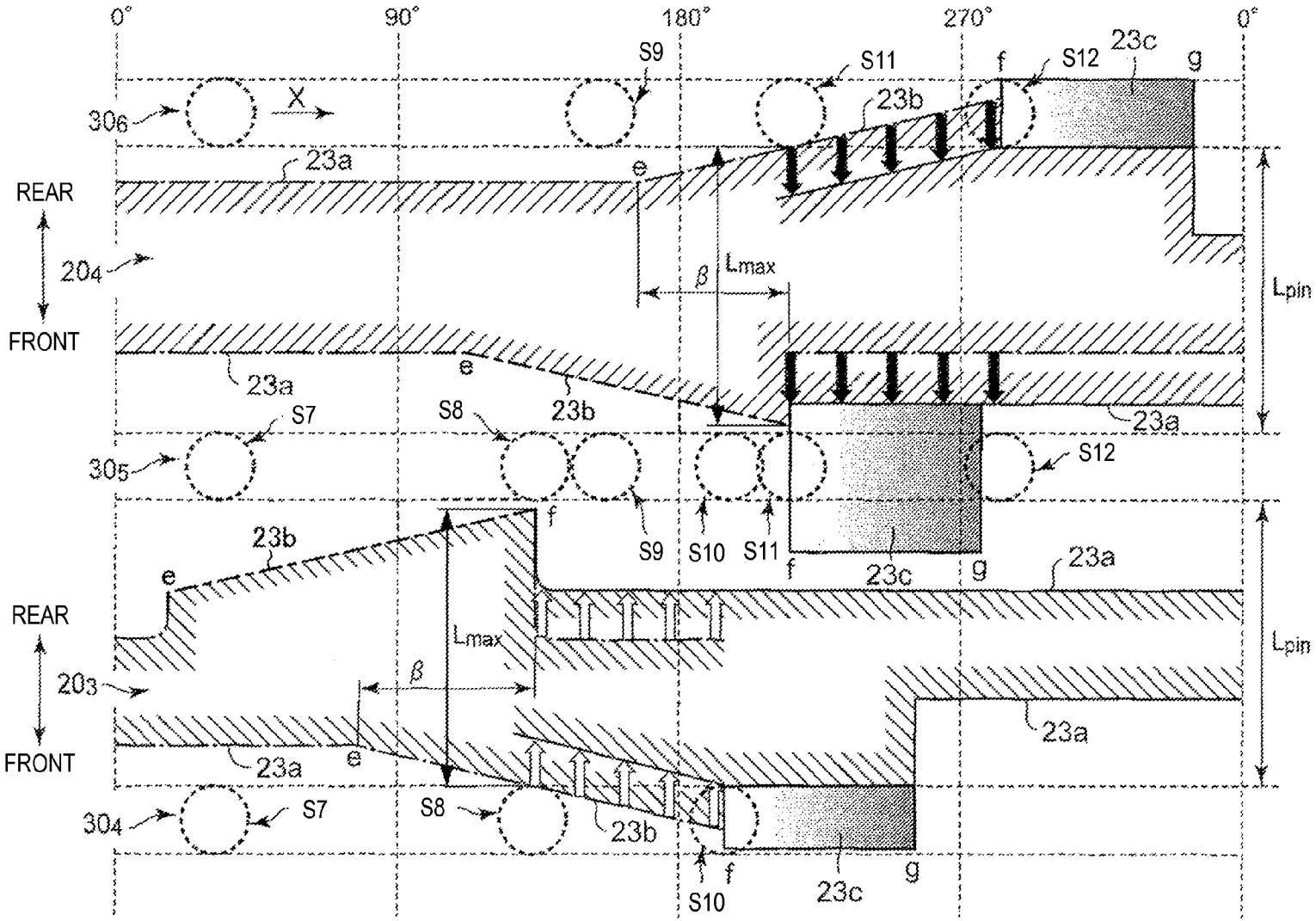
FIG. 11 is an enlarged developed view of a main part along circumferences of the end cams, illustrating a positional relationship among the end face cams and switching members in bringing the cam elements of the third and fourth cylinders closer to each other.

Further, in this embodiment, as it is obvious by comparison between FIGS. 7A and 7B (or FIGS. 9A and 9B), the protruding portions 23*b* of the front and rear end face cams 23 of each of the cam elements $20_1$ to $20_4$ are formed so that their phase ranges a from the protrusion start position e to the protrusion end position f overlap with each other at least within a part of a phase range β (illustrated in FIGS. 10 and 11).

Moreover, due to the respective cam elements $20_1$ to $20_4$ spline-fitted onto the camshaft 2 with a predetermined phase difference from each other according to the combustion order of the cylinders $1_1$ to $1_4$ as described above, the opposing end face cams 23 of adjacent cam elements among the respective cam elements $20_1$ to $20_4$ also have phase differences from each other. In this embodiment, as indicated by "P1" and "P2" in FIG. 1, a pair of the adjacent first and second cam elements $20_1$ and $20_2$ and a pair of the adjacent third and fourth cam elements $20_3$ and $20_4$ are arranged so that the protruding portions 23*b* of the opposing end face cams 23 of each pair are provided in different phases from each other, and when the pair of the adjacent first and second cam elements $20_1$ and $20_2$ are close to each other and the pair of the adjacent third and fourth cam elements $20_3$ and $20_4$ are close to each other, the opposing protruding portions 23*b* at least partially overlap with each other in the camshaft directions. Here, a shortest length of the distance between the cam surfaces of the opposing end face cams 23 in the same phase in the camshaft directions is shorter than a diameter of the switching member 32.

Then, when the pair of the adjacent first and second cam elements $20_1$ and $20_2$ are close to each other and the pair of the adjacent third and fourth cam elements $20_3$ and $20_4$ are close to each other, each of the switching members 32 of the second and fifth switching devices $30_2$ and $30_5$ projects to the position between the opposing faces of the end face cams 23 (actuated positions) and engages with the end face cams 23. Thus, the switching members 32 shift the pair of the first and second cam elements $20_1$ and $20_2$ which are close to each other and the pair of the third and fourth cam elements $20_3$ and $20_4$ which are close to each other, to separate them according to the rotation of the camshaft 2.

Here, each of the pair of the first and second cam elements $20_1$ and $20_2$ and the pair of the third and fourth cam elements $20_3$ and $20_4$, each pair close to each other in the state illustrated in FIG. 1, moves from the respective first positions to the respective second positions illustrated in FIG. 4 by being separated from each other. Moreover, the second and third cam elements $20_2$ and $20_3$, which are separated from each other in the state illustrated in FIG. 1, move close to each other.

On the other hand, as illustrated in FIG. 4, in the state where the first cam element $20_1$ is at the second position, which is the forward position, the switching member 32 of the first switching device $30_1$ projects to the position adjacent, in the camshaft directions, to the front end face cam 23 of the first cam element $20_1$ (actuated position), to engage with the end face cam 23, and the switching member 32 shifts the first cam element $20_1$ to the first position, which is the rearward position, according to the rotation of the camshaft 2. Similarly, in the state where the third cam element $20_3$ is at the second position, which is the forward position, the switching member 32 of the fourth switching device $30_4$ projects to the position adjacent, in the camshaft directions, to the front end face cam 23 of the third cam element $20_3$ (actuated position), to engage with the end face cam 23, and the switching member 32 shifts the third cam element $20_3$ to the first position, which is the rearward position, according to the rotation of the camshaft 2.

Moreover, in the state where the second cam element $20_2$ is at the second position, which is the rearward position, the switching member 32 of the third switching device $30_3$ projects to the position adjacent, in the camshaft directions, to the rear end face cam 23 of the second cam element $20_2$ (actuated position), to engage with the end face cam 23, and the switching member 32 shifts the second cam element $20_2$ to the first position, which is the forward position. Similarly, in the state where the fourth cam element $20_4$ is at the second position, which is the rearward position, the switching member 32 of the sixth switching device $30_6$ projects to the position adjacent, in the camshaft directions, to the rear end face cam 23 of the fourth cam element $20_4$ (actuated position), to engage with the end face cam 23. Thus, the switching member 32 shifts the fourth cam element $20_4$ to the first position, which is the forward position.

Here, the switching members 32 of the switching devices $30_1$ to $30_6$ are projected to the respective actuated positions at the following timings. Specifically, each of the switching members 32 of the first and fourth switching devices $30_1$ and $30_4$ is projected to the actuated position at a timing at which the reference surface 23*a* of the front end face cam 23 of the corresponding cam element between the first and third cam elements $20_1$ and $20_3$ is on the same side in the circumferential direction of the camshaft as an oriented position of the corresponding switching member 32 and adjacent in the camshaft directions to the oriented position. Moreover, each of the switching members 32 of the third and sixth switching devices $30_3$ and $30_6$ is projected to the actuated positions at a timing at which the reference surface 23*a* of the rear end face cam 23 of the corresponding cam element among the second and fourth cam elements $20_2$ and $20_4$ is adjacent to the oriented position of the corresponding switching member 32 in the camshaft directions. Further, the switching member 32 of the second switching device $30_2$ is projected to the actuated position at a timing at which the reference faces 23*a* of both of the two opposing front end face cams 23 of the first and second cam elements $20_1$ and $20_2$ are adjacent to the oriented position of the corresponding switching member 32 in the camshaft directions. The switching member 32 of the fifth switching device $30_5$ is projected to the actuated position at a timing at which the reference faces 23*a* of both of the two opposing front end face cams 23 of the third and fourth cam elements $20_3$ and $20_4$ are adjacent to the oriented position of the corresponding switching member 32 in the camshaft directions.

Moreover, the shifting of each of the cam elements $20_1$ to $20_4$ by projecting the switching member 32 to its actuated position needs to be performed at a timing at which the position of the cam follower C' of the rocker arm C corresponds to the base circle a of either one of the first and second cams $22_1$ and $22_2$, in other words, at a timing at which the corresponding cylinder is not on exhaust stroke.

Therefore, to satisfy the conditions of the operation timings, in this embodiment, as illustrated in FIGS. 7A and 7B, the protrusion start position e of the end face cam 23 is set to a position in a predetermined phase on the forward (advancing) side in the rotational direction X from the tops of the nose portions $b_1$ and $b_2$ of the first and second cams $22_1$ and $22_2$, and the protrusion end position f of the end face cam 23 is set to a position in the predetermined phase a on the rearward (retarding) side in the rotational direction X from the protrusion start position e. Thus, the nose portions $b_1$ and $b_2$ of the first and second cams $22_1$ and $22_2$ are in a positional relationship such that an angle formed rearward in the rotational direction X from the protrusion start position e of the end face cam 23 to a lift end position of the nose portions $b_1$ and $b_2$ of the first and second cams $22_1$ and $22_2$ is smaller than 180°. In this case, based on the positional relationship of the cam followers C' of the rocker arms C with the switching members 32 of the first to sixth switching devices $30_1$ to $30_6$ as illustrated in FIG. 2, the respective cam elements $20_1$ to $20_4$ shift immediately after the exhaust stroke ends.

In this embodiment, a return slope 23*c*, for forcing the switching member 32 projected to the actuated position to retreat to the non-actuated position, is integrally formed in the end face cams 23 of the cam elements $20_1$ to $20_4$. The switching member 32 projected to the actuated position is returned to the non-actuated position by the return slope 23*c* to be held at the non-actuated position by the permanent magnet.

An actual position to dispose the return slope 23*c* changes depending on a condition, such as the switching order of the cams $22_1$ and $22_2$ of the cam elements $20_1$ to $20_4$ and the number of the switching devices disposed. However, regardless of the condition, for the adjacent cam elements (in this embodiment, the pair of first and second cam elements $20_1$ and $20_2$, and the pair of the third and fourth cam elements $20_3$ and $20_4$) which are shifted by the corresponding common switching device (in this embodiment, the second switching device $30_2$ and the fifth switching device $30_5$), it is required to form the return slope 23*c* at least in one of the opposing end face cams 23 of the cam elements which is shifted after the other cam element by the common switching device. In this embodiment, since the cams $22_1$ and $22_2$ are switched therebetween in the cam elements $20_1$ to $20_4$ of the respective cylinders $1_1$ to $1_4$ in the order of the third cylinder 13, the fourth cylinder $1_4$, the second cylinder 12, and then the first cylinder which is the same as the combustion order, between the first and second cam elements $20_1$ and $20_2$, the first cam element $20_1$ is shifted later by the second switching device $30_2$, and between the third and fourth cam elements $20_3$ and $20_4$, the fourth cam element $20_4$ is shifted later by the fifth switching device $30_5$. In this embodiment, the return slope 23*c* is formed in each of the front and rear end face cams 23 of the first and fourth cam elements $20_1$ and $20_4$ and the rear end face cam 23 of the second cam element $20_2$, and the front end face cam 23 of the third cam element $20_3$.

As illustrated in FIGS. 6 to 9, the return slope 23*c* protrudes in one of the camshaft directions from the protruding portion 23*b* and is formed over a predetermined phase range of the cam surface of the end face cam 23 on the rotation retarding side (direction opposite to the arrow X) with respect to the protrusion end position f of the end face cam 23, specifically, from the protruding end position f (i.e., slope start position) to the slope end position g. The return slope 23*c* has a cam surface extending to the rotation retarding side while inclining outward in a radial direction of the camshaft, in other words, a cam surface of which lift (thickness of the slope in the radial direction) gradually becomes higher toward the rotation retarding side. The lift of the cam surface is set so that it is positioned slightly radially inward at the slope start position f compared to a position of a tip of the switching member 32 which is at the actuated position, and positioned slightly radially inward at the slope end position g compared to the position of the tip of the switching member 32 which is at the non-actuated position.

The return slope 23*c* can force the switching member 32 to retreat from the actuated position to the non-actuated position by sliding with the cam surface in contact with the tip of the switching member 32 after the corresponding cam element ($20_1$ to $20_4$) is shifted by the protruding portion 23*b*. Note that, although the lift at the slope end position g is lower than the tip of the switching member 32 which is at the non-actuated position as described above, before the switching member 32 reaches the slope end position g from the slope start position f, it is returned to the non-actuated position by an inertial force applied to the switching member 32 and the magnetic force of the permanent magnet.

Moreover, the return slope 23*c* is arranged in the end face cam 23 such that when the corresponding adjacent cam elements are separated from each other, the return slope 23*c* is adjacent to the oriented position of the corresponding switching member 32 in the camshaft directions. Further, the return slope 23*c* is arranged such that when the adjacent cam elements are close to each other, the opposing end face cams 23 thereof do not interfere with each other, particularly the return slope 23*c* of one of the opposing end face cams 23 does not interfere with the protruding portion 23*b* of the other end face cam 23.

In this embodiment, although the return slope 23*c* is formed integrally with the end face cam 23 together with the protruding portion 23*b*, the return slope 23*c* may be formed as a separate component from any of the cam elements $20_1$ to $20_4$ provided with the end face cams 23 and then integrated by being assembled with the corresponding cam element ($20_1$ to $20_4$).

Next, the operation of the valve operating system is described with reference to FIGS. 10 and 11. Note that FIGS. 10 and 11 are views illustrating the rotations of the third and fourth cam elements $20_3$ and $20_4$ with respect to the switching members 32 of the fourth to sixth switching devices $30_4$ to $30_6$, as relative movements of the switching members 32 with respect to the cam elements $20_3$ and $20_4$ in the circumferential direction of the end face cam 23 (from left to right in FIGS. 10 and 11). Further, the end face cams 23 of the cam elements $20_3$ and $20_4$ when they are close to each other (at the respective first positions) are indicated by the solid lines, and the end face cams 23 of the cam elements $20_3$ and $20_4$ when they are separated from each other (at the respective second positions) are indicated by the one-dot chain lines.

Firstly, as illustrated in FIG. 1, for example, when the engine is operated at a high speed and the first to fourth cam elements $20_1$ to $20_4$ are positioned at the respective first positions, in each of the cam elements $20_1$ to $20_4$, the positions of the first cams $22_1$ with the high lifts in the operating parts 22 correspond to the cam followers C' of the rocker arms C, and the exhaust valves A of each of the cylinders $1_1$ to $1_4$ open to a relatively large degree on the exhaust stroke in the combustion order, according to the rotation of the camshaft 2.

To switch from this state to a state where the opening degree of the exhaust valves A is small due to, for example, a decrease in the engine speed, the switching members 32 are projected from the respective non-actuated positions to the respective actuated positions by distributing power to the second and fifth switching devices $30_2$ and $30_5$.

Specifically, first, the switching member 32 of the fifth switching device 30*s* is projected to the position (actuated position) between the opposing end face cams 23 of the third and fourth cam elements $20_3$ and $20_4$ which are close to each other at the respective first positions, and the switching member 32 engages with the end face cams 23. In this case, as indicated by a reference numeral "S1" in FIG. 10, the switching member 32 of the fifth switching device 30*s* is projected in a period in which the oriented position of the switching member 32 is adjacent, in the camshaft directions, to the reference surfaces 23*a* where the protruding amounts of the opposing end face cams 23 (indicated by the solid lines) of the third and fourth cam elements $20_3$ and $20_4$ are both zero.

Then, after the exhaust stroke of the third cylinder 13 ends, the protrusion start position e of the rear end face cam 23 of the third cam element $20_3$ reaches the position of the switching member 32 of the fifth switching device $30_5$. Then, between positions indicated by reference numerals "S2" and "S3" in FIG. 10, the switching member 32 of the fifth switching device $30_5$ pushes the third cam element $20_3$ forward (indicated by white downward arrows) while sliding in contact with the protruding portion 23*b* of the rear end face cam 23 of the third cam element $20_3$ according to the rotation of the camshaft 2 so as to shift the third cam element $20_3$ to the second position (indicated by the one-dot chain line).

By shifting the third cam element $20_3$ as above, the front end face cam 23 of the third cam element $20_3$ approaches the switching member 32 of the fourth switching device $30_4$ which is at the non-actuated position. Here, in the third cam element $20_3$, the distance in the camshaft directions between the cam surfaces of the end face cams 23 in the same phase becomes the longest length Lmax in either one of the phase corresponding to the protrusion end position f of the protruding portion 23*b* of the front end face cam 23 and the phase corresponding to the protrusion end position f of the protruding portion 23*b* of the rear end face cam 23. The longest length Lmax is set to be shorter than the distance Lpin in the camshaft directions between the switching members 32 (at actuated positions) at both sides of the third cam element $20_3$ (in FIG. 10, Lmax<Lpin). Therefore, as indicated by a reference numeral "S3" in FIG. 10, when the third cam element $20_3$ is shifted to its most-forward position by the engaging between the switching member 32 of the fifth switching device $30_5$ and the rear end face cam 23 of the third cam element $20_3$ at the protrusion end position f, even if the switching member 32 of the fourth switching device $30_4$ is projected to the actuated position due to an operation defect or the like, the projected switching member 32 of the fourth switching device $30_4$ does not contact the protruding portion 23*b* of the front end face cam 23 of the third cam element $20_3$ at this point, but does contact as the camshaft 2 rotates thereafter. By the timing of the contact, the switching member 32 of the fifth switching device $30_5$ has already passed the protrusion end position f. Therefore, the switching member 32 of the fifth switching device $30_5$ does not contact the rear end face cam 23 of the third cam element $20_3$. Since the distance in the camshaft directions between the cam surfaces of the end face cams 23 of the third cam element $20_3$ in the same phase is always shorter than the distance Lpin in the camshaft directions between the switching members 32 at both sides of the third cam element $20_3$ as above, the third cam element $20_3$ does not become unrotatable by getting stuck between the switching members 32 positioned at both sides of the third cam element $20_3$ in any phase.

Moreover, when the protrusion start position e of the rear end face cam 23 of the third cam element $20_3$ reaches the position adjacent to the oriented position of the switching member 32 of the fifth switching device $30_5$ in the camshaft directions, the camshaft 2 rotates by 90°, and the exhaust stroke of the fourth cylinder $1_4$ ends. Next, the protrusion start position e of the front end face cam 23 of the fourth cam element $20_4$ reaches the position adjacent to the oriented position of the switching member 32 of the fifth switching device $30_5$ in the camshaft directions. Then, between positions indicated by reference numerals "S4" and "S5" in FIG. 10, the switching member 32 of the fifth switching device $30_5$ pushes the fourth cam element $20_4$ rearward (indicated by thick and dark upward arrows) while sliding in contact with the protruding portion 23*b* of the front end face cam 23 of the fourth cam element $20_4$ according to the rotation of the camshaft 2 so as to shift the fourth cam element $20_4$ to the second position (indicated by the one-dot chain line).

By shifting the fourth cam element $20_4$ as above, the rear end face cam 23 of the fourth cam element $20_4$ approaches the switching member 32 of the sixth switching device $30_6$ which is at the non-actuated position. Here, similar to the third cam element $20_3$, also in the fourth cam element $20_4$, Lmax≤Lpin is satisfied (in FIG. 10, Lmax<Lpin). Therefore, as indicated by the reference numeral "S5" in FIG. 10, when the fourth cam element $20_4$ is shifted to its most-rearward position by the engaging between the switching member 32 of the fifth switching device $30_5$ and the front end face cam 23 of the fourth cam element $20_4$ at the protrusion end position f, even if the switching member 32 of the sixth switching device $30_6$ is projected to the actuated position due to an operation defect or the like, the projected switching member 32 of the sixth switching device $30_6$ does not contact the protruding portion 23*b* of the rear end face cam 23 of the fourth cam element $20_4$ at this point, but they contact as the camshaft 2 rotates thereafter. By the timing of the contact, the switching member 32 of the fifth switching device $30_5$ has already passed the protrusion end position f. Therefore, the switching member 32 of the fifth switching device $30_5$ does not contact the front end face cam 23 of the fourth cam element $20_4$. Since the distance in the camshaft directions between the cam surfaces of the end face cams 23 of the fourth cam element $20_4$ in the same phase is always shorter than the distance Lpin in the camshaft directions between the switching members 32 at both sides of the fourth cam element $20_4$ as above, in any phase, the fourth cam element $20_4$ does not become unrotatable by getting stuck between the switching members 32 positioned at both sides of the fourth cam element $20_4$.

Further, when the switching member 32 of the fifth switching device $30_5$ passes the reference numeral "S5" in FIG. 10, the power distribution to the electromagnetic actuator is suspended. Then, the switching member 32 is forcibly returned to the non-actuated position by being pushed upward while its tip surface slides in contact with the cam surface of the return slope 23*c*.

Next, the switching member 32 of the second switching device $30_2$ is projected to the position (actuated position) between the opposing end face cams 23 of the first and second cam elements $20_1$ and $20_2$ which are close to each other at the respective first positions, and the switching member 32 engages with the end face cams 23. In this case, the switching member 32 of the second switching device $30_2$ is projected in a period in which the oriented position of the switching member 32 is adjacent, in the camshaft directions, to the reference surfaces 23*a* where the protruding amounts of the opposing end face cams 23 of the first and second cam elements $20_1$ and $20_2$ are both zero.

Then, after the exhaust stroke of the second cylinder 12 ends, the protrusion start position e of the front end face cam 23 of the second cam element $20_2$ reaches the position of the switching member 32 of the second switching device $30_2$. Then, the switching member 32 of the second switching device $30_2$ pushes the second cam element $20_2$ rearward while sliding in contact with the protruding portion 23*b* of the front end face cam 23 of the second cam element $20_2$ according to the rotation of the camshaft 2 so as to shift the second cam element $20_2$ to the second position. Therefore, the second cam element $20_2$ also does not become unrotatable by getting stuck between the switching members 32 positioned at both sides of the second cam element $20_2$.

Moreover, when the protrusion start position e of the front end face cam 23 of the second cam element $20_2$ reaches the position adjacent to the oriented position of the switching member 32 of the second switching device $30_2$ in the camshaft directions, the camshaft 2 rotates by 90°, the exhaust stroke of the first cylinder $1_1$ ends, and the protrusion start position e of the rear end face cam 23 of the first cam element $20_1$ reaches the position adjacent to the oriented position of the switching member 32 of the second switching device $30_2$ in the camshaft directions. Then, the switching member 32 of the second switching device $30_2$ pushes the first cam element $20_1$ forward while sliding in contact with the protruding portion 23*b* of the rear end face cam 23 of the first cam element $20_1$ according to the rotation of the camshaft 2 so as to shift the first cam element $20_1$ to the second position. Therefore, the first cam element $20_1$ also does not become unrotatable by getting stuck between the switching members 32 positioned at both sides of the first cam element $20_1$.

Further, the power distribution to the electromagnetic actuator of the second switching device $30_2$ is suspended. Then, similar to the fifth switching device $30_5$ described above, the switching member 32 is forcibly returned to the non-actuated position by being pushed upward while its tip surface slides in contact with the cam surface of the return slope 23*c*.

By the above operations, all the first to fourth cam elements $20_1$ to $20_4$ shift from the respective first positions to the respective second positions, and as illustrated in FIG. 4, in all the first to fourth cam elements $20_1$ to $20_4$, the positions of the second cams $22_2$ of the two operating parts 22 respectively correspond to the cam followers C' of the rocker arms C, and the exhaust valves A of the respective cylinders $1_1$ to $1_4$ open to a relatively small degree on the exhaust stroke.

On the other hand, when switching, due to, for example, the increase in the engine speed, from the state illustrated in FIG. 4 where the positions of the second cams $22_2$ having the low lifts in the respective cam elements $20_1$ to $20_4$ correspond to the cam followers C' of the rocker arms C, to the state illustrated in FIG. 1 where the positions of the first cams $22_1$ having the high lifts correspond to the cam followers C', the switch operation is performed by distributing power to the electromagnetic actuators of the first, third, fourth, and sixth switching devices $30_1$, $30_3$, $30_4$, and $30_6$ to project the switching members 32 thereof from the respective non-actuated positions to the respective actuated positions.

Specifically, first, as indicated by a reference numeral "S7" in FIG. 11, as soon as the switching member 32 of the fourth switching device $30_4$ enters the period in which the oriented position of the switching member 32 is adjacent, in the camshaft directions, to the reference surface 23*a* where the protruding amounts of the front end face cams 23 of the third cam element $20_3$ are both zero, the switching member 32 projects to the position adjacent, in the camshaft directions, to the end face cam 23 (actuated position).

After the exhaust stroke of the third cylinder 13 ends, the protrusion start position e of the front end face cam 23 of the third cam element $20_3$ reaches the position adjacent to the oriented position of the projected switching member 32 of the fourth switching device $30_4$ in the camshaft directions. Then, between positions indicated by reference numerals "S8" to "S10" in FIG. 11, the switching member 32 of the fourth switching device $30_4$ pushes the third cam element $20_3$ rearward (indicated by white upward arrows) while sliding in contact with the protruding portion 23*b* of the front end face cam 23 of the third cam element $20_3$ according to the rotation of the camshaft 2 so as to shift the first cam element $20_1$ to the first position (indicated by the solid line).

By shifting the third cam element $20_3$ as above, the rear end face cam 23 of the third cam element $20_3$ approaches the switching member 32 of the fifth switching device $30_5$ which is at the non-actuated position. Here, the third cam element $20_3$ is formed to satisfy Lmax≤Lpin (in FIG. 11, Lmax<Lpin) as described above. Therefore, while the third cam element $20_3$ is moved rearward by the switching member 32 of the fourth switching device $30_4$, as indicated by the reference numeral "S8" in FIG. 11, although the rear end face cam 23 of the third cam element $20_3$ approaches the switching member 32 of the fifth switching device $30_5$ the most at the protrusion end position f, even if the switching member 32 of the fifth switching device 30*s* is projected to the actuated position due to an operation defect or the like, the projected switching member 32 of the fifth switching device 30*s* does not contact the rear end face cam 23 of the third cam element $20_3$ at this point. Even if the third cam element $20_3$ is shifted further rearward by the switching member 32 of the fourth switching device $30_4$ thereafter, the switching member 32 of the fifth switching device $30_5$ has already passed the protrusion end position f by this point. Therefore, the switching member 32 of the fifth switching device $30_5$ does not contact the rear end face cam 23 of the third cam element $20_3$. Since the distance in the camshaft directions between the cam surfaces of the end face cams 23 of the third cam element $20_3$ in the same phase is always shorter than the distance Lpin in the camshaft directions between the switching members 32 at both sides of the third cam element $20_3$ as above, in any phase, the third cam element $20_3$ does not become unrotatable by getting stuck between the switching members 32 positioned at both sides of the third cam element $20_3$.

Moreover, when the protrusion start position e of the front end face cam 23 of the third cam element $20_3$ reaches the position adjacent to the oriented position of the switching member 32 of the fourth switching device $30_4$ in the camshaft directions, the camshaft 2 rotates by 90°, and the exhaust stroke of the fourth cylinder $1_4$ ends. Then, as indicated by a reference numeral "S9" in FIG. 11, the switching member 32 of the sixth switching device $30_6$ is projected in a period in which the oriented position of the switching member 32 is adjacent, in the camshaft directions, to the reference surface 23*a* where the protruding amount of the rear end face cam 23 of the fourth cam element $20_4$ at the second position is zero, and the switching member 32 engages with the rear end face cam 23.

After the exhaust stroke of the fourth cylinder $1_4$ ends, the protrusion start position e of the rear end face cam 23 of the fourth cam element $20_4$ reaches the position adjacent to the oriented position of the switching member 32 of the sixth switching device $30_6$ in the camshaft directions. Then, between positions indicated by reference numerals "S11"

and "S12" in FIG. 11, the switching member 32 of the sixth switching device $\mathbf{30}_6$ pushes the fourth cam element $\mathbf{20}_4$ forward (indicated by thick and dark downward arrows) while sliding in contact with the protruding portion 23*b* of the rear end face cam 23 of the fourth cam element $\mathbf{20}_4$ according to the rotation of the camshaft 2 so as to shift the fourth cam element $\mathbf{20}_4$ to the first position (indicated by the solid line).

By shifting the fourth cam element $\mathbf{20}_4$ as above, the front end face cam 23 of the fourth cam element $\mathbf{20}_4$ approaches the switching member 32 of the fifth switching device $\mathbf{30}_5$ which is at the non-actuated position. While the fourth cam element $\mathbf{20}_4$ is moved forward by the switching member 32 of the sixth switching device $\mathbf{30}_6$, as indicated by the reference numeral "S11" in FIG. 11, although the front end face cam 23 of the fourth cam element $\mathbf{20}_4$ approaches the switching member 32 of the fifth switching device 30*s* the most at the protrusion end position f, even if the switching member 32 of the fifth switching device 30*s* is projected to the actuated position due to an operation defect or the like, the projected switching member 32 of the fifth switching device $\mathbf{30}_5$ does not contact the front end face cam 23 of the fourth cam element $\mathbf{20}_4$ at this point for a similar reason to the case of the third cam element $\mathbf{20}_3$. Even if the fourth cam element $\mathbf{20}_4$ is shifted further forward by the switching member 32 of the sixth switching device $\mathbf{30}_6$ thereafter, the switching member 32 of the fifth switching device $\mathbf{30}_5$ has already passed the protrusion end position f of the protruding portion 23*b* by this point. Therefore, the switching member 32 of the fifth switching device $\mathbf{30}_5$ does not contact the front end face cam 23 of the fourth cam element $\mathbf{20}_4$. Since the distance in the camshaft directions between the cam surfaces of the end face cams 23 of the fourth cam element $\mathbf{20}_4$ in the same phase is always shorter than the distance Lpin in the camshaft directions between the switching members 32 on both sides of the fourth cam element $\mathbf{20}_4$ as above, in any phase, the fourth cam element $\mathbf{20}_4$ does not become unrotatable by getting stuck between the switching members 32 on both sides of the fourth cam element $\mathbf{20}_4$.

Then, when the slope 23*c* of the front end face cam 23 of the fourth switching device $\mathbf{30}_4$ is not at the oriented position of the switching member 32 of the fifth switching device $\mathbf{30}_5$ in the camshaft directions, the switching member 32 of the fifth switching device $\mathbf{30}_5$ can move to the actuated position.

Here, the switching member 32 of the third switching device $\mathbf{30}_3$ projects to the position adjacent, in the camshaft directions, to the rear end face cam 23 of the second cam element $\mathbf{20}_2$, and the switching member 32 of the third switching device $\mathbf{30}_3$ pushes the second cam element $\mathbf{20}_2$ forward while sliding in contact with the protruding portion 23*b* of the rear end face cam 23 of the second cam element $\mathbf{20}_2$ according to the rotation of the camshaft 2 so as to shift the second cam element $\mathbf{20}_2$ to the first position. Therefore, the second cam element $\mathbf{20}_2$ also does not become unrotatable by getting stuck between the switching members 32 positioned at both sides of the second cam element $\mathbf{20}_2$.

Moreover, substantially in parallel to the shifting of the second cam element $\mathbf{20}_2$, the switching member 32 of the first switching device $\mathbf{30}_1$ projects to the position adjacent, in the camshaft directions, to the front end face cam 23 in a period in which the oriented position of the switching member 32 is adjacent, in the camshaft directions, to the reference surface 23*a* of the front end face cam 23 of the first cam element $\mathbf{20}_1$ at the second position.

Further, when the protrusion start position e of the end face cam 23 of the second cam element $\mathbf{20}_2$ reaches the position adjacent to the oriented position of the switching member 32 of the third switching device $\mathbf{30}_3$ in the camshaft directions, the camshaft 2 rotates by 90°, and the exhaust stroke of the first cylinder $\mathbf{1}_1$ ends. Next, the protrusion start position e of the front end face cam 23 of the first cam element $\mathbf{20}_1$ reaches the position adjacent to the oriented position of the switching member 32 of the first switching device $\mathbf{30}_1$ in the camshaft directions. Then, the switching member 32 of the first switching device $\mathbf{30}_1$ pushes the first cam element $\mathbf{20}_1$ rearward while sliding in contact with the protruding portion 23*b* of the end face cam 23 according to the rotation of the camshaft 2 so as to shift the first cam element $\mathbf{20}_1$ to the first position. Therefore, the first cam element $\mathbf{20}_1$ also does not become unrotatable by getting stuck between the switching members 32 positioned at both sides of the first cam element $\mathbf{20}_1$.

By the above operations, all the first to fourth cam elements $\mathbf{20}_1$ to $\mathbf{20}_4$ shift from the respective second positions to the respective first positions, and as illustrated in FIG. 1, they return to the state where the positions of the first cams $\mathbf{22}_1$ of the two operating parts 22 of each of the first to fourth cam elements $\mathbf{20}_1$ to $\mathbf{20}_4$ respectively correspond to the cam followers C' of the rocker arms C.

Thus, according to this embodiment, the four cam elements $\mathbf{20}_1$ to $\mathbf{20}_4$ provided to the four cylinders $\mathbf{1}_1$ to $\mathbf{1}_4$ are shifted by the six switching devices $\mathbf{30}_1$ to $\mathbf{30}_6$ to switch their cams for opening and closing the exhaust valves A between the first cams $\mathbf{22}_1$ with the low lift and the second cams $\mathbf{22}_2$ with the high lift.

Next, the pair of detent mechanisms 40 (40*a* and 40*b*) provided to each of the cam elements $\mathbf{20}_1$ to $\mathbf{20}_4$ is described in detail. Here, the detent mechanisms 40 provided to the first cam element $\mathbf{20}_1$ are described as an example, with reference to FIGS. 12 to 16.

Figure 12:
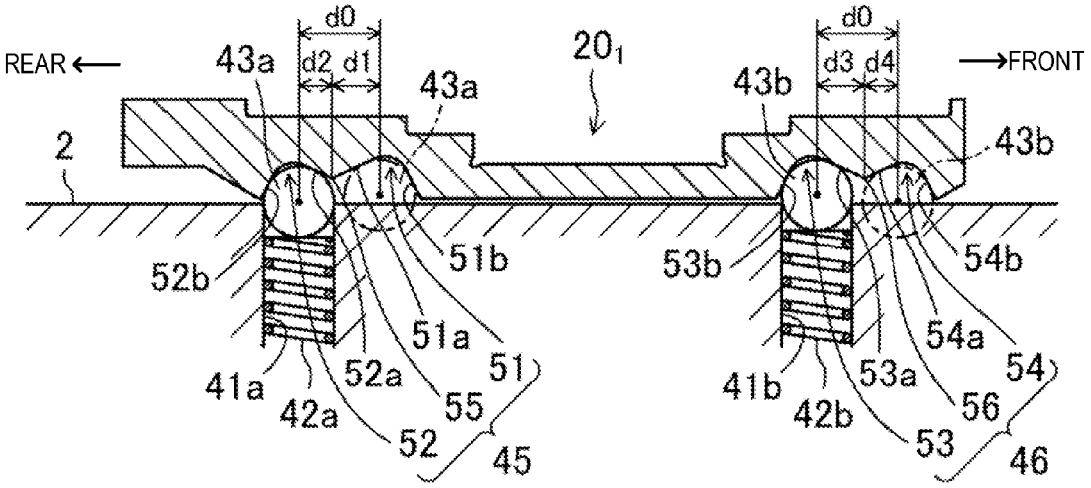
FIG. 12 is a cross-sectional view illustrating a specific configuration of a detent mechanism in a state where a first cam element is at a second position.
Figure 13:
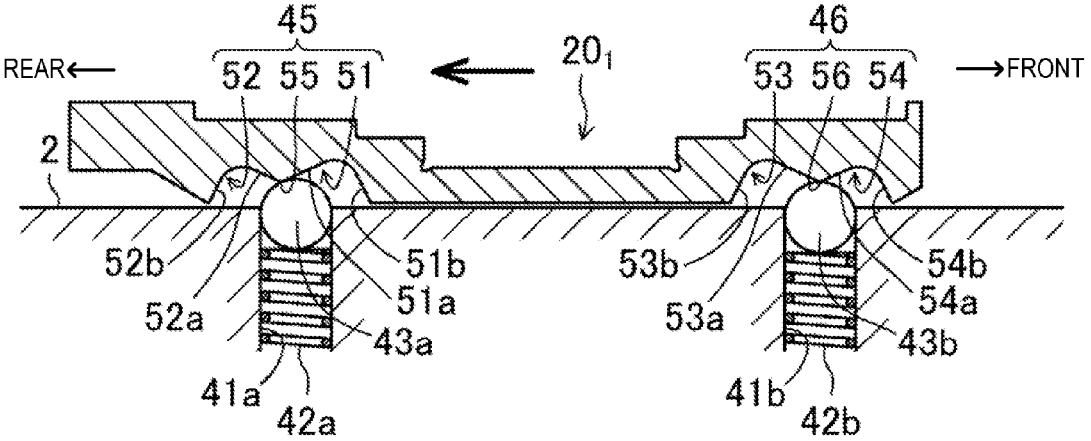
FIG. 13 is a view corresponding to FIG. 12, illustrating a state of the first cam element being shifted from the second position to a first position (a state where a first detent ball just crossed over a first top portion).
Figure 14:
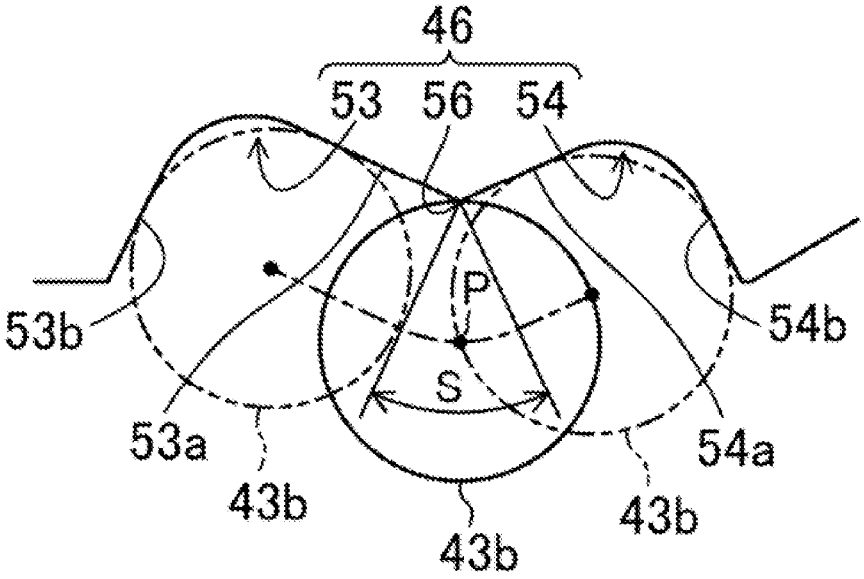
FIG. 14 is an enlarged view illustrating a vicinity of a second detent cam in FIG. 13.
Figure 15:
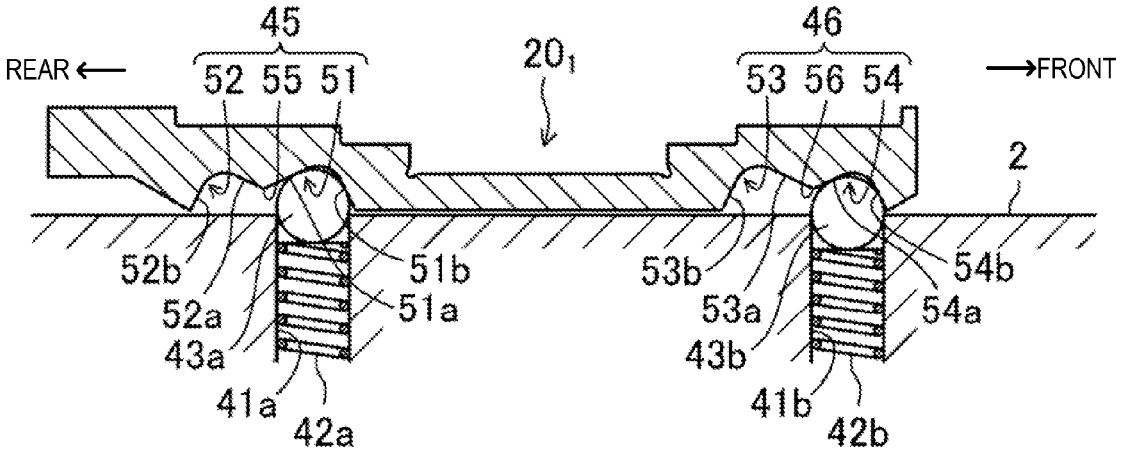
FIG. 15 is a view corresponding to FIG. 12, illustrating a state where the first cam element is at the first position.
Figure 16:
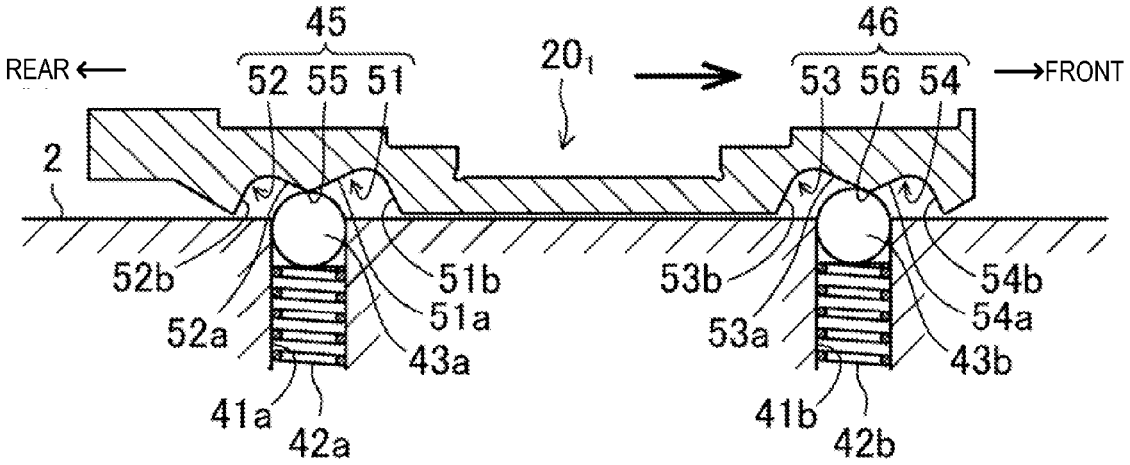
FIG. 16 is a view corresponding to FIG. 12, illustrating a state of the first cam element being shifted from the first position to the second position (a state where a second detent ball just crossed over a second top portion).

FIG. 12 is a view illustrating the state where the first cam element $\mathbf{20}_1$ is at the second position, and FIG. 13 is a view illustrating the state of the first cam element $\mathbf{20}_1$ being shifted from the second position to the first position (the state where the first detent ball 43*a* has just crossed over the first top portion 55). FIG. 14 is an enlarged view illustrating a vicinity of the second detent cam 46 in FIG. 13. FIG. 15 is a view illustrating the state where the first cam element $\mathbf{20}_1$ is at the first position, and FIG. 16 is a view illustrating the state of the first cam element $\mathbf{20}_1$ being shifted from the first position to the second position (the state where the second detent ball 43*b* has just crossed over the second top portion 56).

The first and second grooves 51 and 52 of the first detent cam 45 of the first detent mechanism 40*a* which is the rear detent mechanism in the pair of detent mechanisms 40 have inclining portions 51*a* and 52*a* (inclining surfaces) extending from the first top portion 55 while inclining toward the bottoms of the grooves 51 and 52 with respect to the camshaft directions, respectively. The inclinations (inclinations in sharp angle) of the inclining portions 51*a* and 52*a* in the camshaft directions are preferably the same as each other and within a range between 20° and 30°. In the first cam element $\mathbf{20}_1$, the first groove 51 (inclining portion 51*a*) is formed forward of the first top portion 55 and the second groove 52 (inclining portion 52*a*) is formed rearward of the first top portion 55. Note that the inclinations of the inclining portions 51*a* and 52*a* with respect to the camshaft directions may be different from each other.

The first groove 51 is formed by front and rear side walls substantially in V-shape. The rear side wall is the inclining portion 51*a* and the front side wall is the inclining portion 51*b* inclining with respect to the camshaft directions. The inclination (inclination in sharp angle) of the inclining portion 51*b* with respect to the camshaft directions is larger than the inclination (inclination in sharp angle) of the inclining portion 51*a* with respect to the camshaft directions, so that when the first cam element $\mathbf{20}_1$ shifts to the first position from the second position, it stops at the first position in cooperation with an inclining portion 54*b* (described later) of the fourth groove 54.

Similar to the first groove 51, the second groove 52 is formed by front and rear side walls substantially in V-shape. The front side wall is the inclining portion 52*a* and the rear side wall is the inclining portion 52*b* inclining with respect to the camshaft directions. The inclination (inclination in sharp angle) of the inclining portion 52*b* with respect to the camshaft directions is larger than the inclination (inclination in sharp angle) of the inclining portion 52*a* with respect to the camshaft directions, so that when the first cam element $\mathbf{20}_1$ shifts from the first position to the second position, it stops at the second position in cooperation with an inclining portion 53*b* (described later) of the third groove 53.

Moreover, a relative moving distance for the first detent ball 43*a* fitted into the first groove 51 to cross over the first top portion 55 with respect to the first cam element $\mathbf{20}_1$ in the camshaft directions is set longer than a relative moving distance for the first detent ball 43*a* fitted into the second groove 52 to cross over the first top portion 55 with respect to the first cam element $\mathbf{20}_1$ in the camshaft directions. Specifically, a distance d1 in the camshaft directions between the center of the first detent ball 43*a* fitted into the first groove 51 and the first top portion 55 is set longer than a distance d2 in the camshaft directions between the center of the first detent ball 43*a* fitted into the second groove 52 and the first top portion 55. The sum of the distances d1 and d2 is a distance d0 between the first and second positions, and the distance d1 is longer than d0/2, and the distance d2 is shorter than d0/2. Moreover, in this embodiment, since the inclinations of the inclining portions 51*a* and 52*a* with respect to the camshaft directions are the same as each other, the depth of the first groove 51 from the first top portion 55 is deeper than the depth of the second groove 52 from the first top portion 55, and accordingly, the first detent ball 43*a* fitted into the first groove 51 is positioned outward in the camshaft-radial directions compared to the position of the first detent ball 43*a* fitted into the second groove 52. Note that, regarding the relative moving distances and the distances d1 and d2, the state where the first detent ball 43*a* is fitted into the first groove 51 (or the second groove 52) corresponds to a state where the first detent ball 43*a* is positioned (fully fitted) in the bottom-most side of the first groove 51 (or the second groove 52).

The third and fourth grooves 53 and 54 of the second detent cam 46 of the second detent mechanism 40*b* which is the front detent mechanism in the pair of detent mechanisms 40 have the inclining portions 53*a* and 54*a* (inclining surfaces) extending from the second top portion 56 while inclining toward the bottoms of the grooves 53 and 54 with respect to the camshaft directions, respectively. The inclinations (inclinations in sharp angle) of the inclining portions 53*a* and 54*a* in the camshaft directions are preferably the same as each other and within a range between 20° and 30°. In the first cam element $\mathbf{20}_1$, the third groove 53 (inclining portion 53*a*) is formed rearward of the second top portion 56 and the fourth groove 54 (inclining portion 54*a*) is formed forward of the second top portion 56. Note that the inclinations of the inclining portions 53*a* and 54*a* with respect to the camshaft directions may be different from each other.

The third groove 53 is formed by front and rear side walls substantially in a V-shape. The front side wall is the inclining portion 53*a* and the rear side wall is the inclining portion 53*b* inclining with respect to the camshaft directions. The inclination (inclination in sharp angle) of the inclining portion 53*b* with respect to the camshaft directions is larger than the inclination (inclination in sharp angle) of the inclining portion 53*a* with respect to the camshaft directions, so that when the first cam element $\mathbf{20}_1$ shifts from the first position to the second position, it stops at the second position as described above, in cooperation with the inclining portion 52*b* of the second groove 52.

Similar to the third groove 53, the fourth groove 54 is also formed by front and rear side walls substantially in a V-shape. The rear side wall is the inclining portion 54*a* and the front side wall is the inclining portion 54*b* inclining with respect to the camshaft directions. The inclination (inclination in sharp angle) of the inclining portion 54*b* with respect to the camshaft directions is larger than the inclination (inclination in sharp angle) of the inclining portion 54*a* with respect to the camshaft directions, so that when the first cam element $\mathbf{20}_1$ shifts to the first position from the second position, it stops at the first position as described above, in cooperation with the inclining portion 51*b* of the first groove 51.

Moreover, a relative moving distance for the second detent ball 43*b* fitted into the third groove 53 to cross over the second top portion 56 with respect to the first cam element $\mathbf{20}_1$ in the camshaft directions is set longer than a relative moving distance for the second detent ball 43*b* fitted into the fourth groove 54 to cross over the second top portion 56 with respect to the first cam element $\mathbf{20}_1$ in the camshaft directions. Specifically, a distance d3 in the camshaft directions between the center of the second detent ball 43*b* fitted into the third groove 53 and the second top portion 56 is set longer than a distance d4 in the camshaft directions between the center of the second detent ball 43*b* fitted into the fourth groove 54 and the second top portion 56. The sum of the distances d3 and d4 is the distance d0 between the first and second positions, and the distance d3 is longer than d0/2, and the distance d4 is shorter than d0/2. Moreover, in this embodiment, since the inclinations of the inclining portions 53*a* and 54*a* with respect to the camshaft directions are the same as each other, the depth of the third groove 53 from the second top portion 56 is deeper than the depth of the fourth groove 54 from the second top portion 56, and accordingly, the second detent ball 43*b* fitted into the third groove 53 is positioned outward in the camshaft-radial directions compared to the position of the second detent ball 43*b* fitted into the fourth groove 54. Note that, regarding the relative moving distances and the distances d3 and d4, the state where the second detent ball 43*b* is fitted into the third groove 53 (or the fourth groove 54) corresponds to a state where the second detent ball 43*b* is positioned (fully fitted) in the bottom-most side of the third groove 53 (or the fourth groove 54).

In this embodiment, the first detent cam 45 (the first and second grooves 51 and 52 and the first top portion 55) and the second detent cam 46 (the third and fourth grooves 53 and 54 and the second top portion 56) are formed symmetric to each other with respect to a plane passing through the center of the first top portion 55 and the second top portion 56 in the camshaft directions and extending perpendicular to the camshaft directions. Moreover, the diameter of the second detent ball 43*b* is the same as the diameter of the first detent ball 43*a*. Therefore, the distance d3 is the same as the distance d1, and the distance d4 is the same as the distance d2, and thus, the distance d3 is longer than the distance d2 and the distance d1 is longer than the distance d4. Note that the first and second detent cams 45 and 46 are not necessarily symmetric to each other with respect to the plane, and for example, in a case where the diameter of the second detent ball 43*b* is different from the diameter of the first detent ball 43*a*, they are normally not symmetric.

Moreover, the first and second detent mechanisms 40*a* and 40*b* are configured as follows. As illustrated in FIG. 12, when the first cam element $\mathbf{20}_1$ is positioned at the second position, the first detent ball 43*a* is fitted into the second groove 52 and the second detent ball 43*b* is fitted into the third groove 53, and in the case of shifting the first cam element $\mathbf{20}_1$ to the one side in the camshaft directions (rearward) from the second position, the first detent ball 43*a* relatively moves to the first top portion 55 side along the inclining portion 52*a* of the second groove 52 and the second detent ball 43*b* relatively moves to the second top portion 56 side along the inclining portion 53*a* of the third groove 53. As illustrated in FIG. 13, when the first detent ball 43*a* just crossed over the first top portion 55, the second detent ball 43*b* is still moving along the second top portion 56 because the distance d3 is longer than the distance d2, and therefore, the first detent ball 43*a* pushes the inclining portion 51*a* of the first groove 51 after the crossing over and causes a force in the shifting direction. Thus, the first and second detent mechanisms 40*a* and 40*b* can assist the shifting of the first cam element $\mathbf{20}_1$ to the one side in the camshaft directions (rearward).

Here, while the second detent ball 43*b* moves along the second top portion 56, as illustrated in FIG. 14, on a movement path (indicated by the one-dot chain line) of a center P of the second detent ball 43*b*, the center P of the second detent ball 43*b* is within a sector area S limited by an arc centering on the second top portion 56. When the center P of the second detent ball 43*b* is within the sector area S, the direction to which the second detent ball 43*b* pushes the second detent cam 46 is not fixed, and whether the second detent ball 43*b* acts to resist or contribute in assisting the rearward shifting of the first cam element $\mathbf{20}_1$ is not certain. Assuming that the second detent ball 43*b* acts to resist, the resisting force of the second detent ball 43*b* is much smaller than the case where the second detent ball 43*b* relatively moves to the second top portion 56 side along the inclining portion 53*a* of the third groove 53. After the center P of the second detent ball 43*b* enters the sector area S from either one of the third and fourth grooves 53 and 54, as the center P of the second detent ball 43*b* exits to the other side, the second detent ball 43*b* crosses over the second top portion 56, and the relationship between the first detent ball 43*a* and the first top portion 55 is similar to this. The distances d2 and d3 are set so that the second detent ball 43*b* is still moving along the second top portion 56 when the first detent ball 43*a* crossed over the first top portion 55.

While the second detent ball 43*b* moves along the second top portion 56, the first detent ball 43*a* has already crossed over the first top portion 55, and the first detent ball 43*a* pushes the inclining portion 51*a* of the first groove 51 to cause the force in the shifting direction and assist the rearward shifting of the first cam element $\mathbf{20}_1$. Therefore, after the crossing over, even if the first cam element $\mathbf{20}_1$ is not pushed rearward by the first switching device $\mathbf{30}_1$, the cam element $\mathbf{20}_1$ is positioned at the first position by the assist. Here, the resisting force of the second detent ball 43*b* moving along the second top portion 56 is quite small as described above, and the assisting force of the first detent ball 43*a* becomes larger than the resisting force. By the assisting force, the first cam element $\mathbf{20}_1$ shifts rearward and the second detent ball 43*b* also eventually crosses over the second top portion 56, which causes the second detent ball 43*b* to also assist the rearward shifting of the first cam element $\mathbf{20}_1$. Thus, the first cam element $\mathbf{20}_1$ can surely be positioned at the first position.

Moreover, the first and second detent mechanisms 40*a* and 40*b* are configured as follows. As illustrated in FIG. 15, when the first cam element $\mathbf{20}_1$ is positioned at the first position, the first detent ball 43*a* is fitted into the first groove 51 and the second detent ball 43*b* is fitted into the fourth groove 54, and in the case of shifting the first cam element $\mathbf{20}_1$ to the other side in the camshaft directions (forward) from the first position, the first detent ball 43*a* relatively moves to the first top portion 55 side along the inclining portion 51*a* of the first groove 51 and the second detent ball 43*b* relatively moves to the second top portion 56 side along the inclining portion 54*a* of the fourth groove 54. As illustrated in FIG. 16, when the second detent ball 43*b* has just crossed over the second top portion 56, the first detent ball 43*a* is still moving along the first top portion 55 because the distance d1 is longer than the distance d4, and therefore, the second detent ball 43*b* pushes the inclining portion 53*a* of the third groove 53 after the crossing over and causes a force in the shifting direction. Thus, the first and second detent mechanisms 40*a* and 40*b* can assist the shifting of the first cam element $\mathbf{20}_1$ to the other side in the camshaft directions (forward). The distances d1 and d4 are set so that the first detent ball 43*a* is still moving along the first top portion 55 when the second detent ball 43*b* crossed over the second top portion 56 (in this embodiment, d1=d3, d4=d2).

While the first detent ball 43*a* moves along the first top portion 55, the second detent ball 43*b* has already crossed over the second top portion 56, and the second detent ball 43*b* pushes the inclining portion 53*a* of the third groove 53 to assist the forward shifting of the first cam element $\mathbf{20}_1$. Therefore, after the crossing over, even if the first cam element $\mathbf{20}_1$ is not pushed forward by the second switching device $\mathbf{30}_2$, the cam element $\mathbf{20}_1$ is positioned at the second position by the assist.

Assuming that the distances d1, d2, d3, and d4 are all the same, the distances d1, d2, d3, and d4 are all d0/2. In this case, either one of the first and second switching devices $\mathbf{30}_1$ and $\mathbf{30}_2$ needs to push the first cam element $\mathbf{20}_1$ by at least d0/2+α (amount for crossing over). Whereas, in this embodiment, when the first cam element $\mathbf{20}_1$ shifts rearward from the second position, the first switching device $\mathbf{30}_1$ only needs to push by the amount for the first detent ball 43*a* fitted into the second groove 52 to cross over the first top portion 55, in other words, the d2(<d0/2)+α. When the first cam element $\mathbf{20}_1$ shifts forward from the first position, the second switching device $\mathbf{30}_2$ only needs to push by the amount for the second detent ball 43*b* fitted into the fourth groove 54 to cross over the second top portion 56, in other words, d4(<d0/2)+α. As a result, the pushing amount of the first cam element $\mathbf{20}_1$ by the first and second switching devices $\mathbf{30}_1$ and $\mathbf{30}_2$ can be reduced, in other words, the protruding lengths of the protruding portions of both end face cams 23 of the first cam element $\mathbf{20}_1$ can be shortened.

Therefore, in this embodiment, by the assisting function of the first and second detent balls 43*a* and 43*b*, the cams $\mathbf{22}_1$ and $\mathbf{22}_2$ for opening and closing the valve can surely be switched therebetween, and the protruding lengths of the protruding portions of both end face cams 23 of the first cam element $\mathbf{20}_1$ can be shortened. As a result, the length of the first cam element $\mathbf{20}_1$ in the camshaft directions can be shortened, which is similar for the second to fourth cam elements $\mathbf{20}_2$ to $\mathbf{20}_4$. Thus, the valve operating system (i.e., the engine) can be reduced in size in the camshaft directions.

Moreover, in this embodiment, the two adjacent cam elements are arranged such that the protruding portions 23*b* of their opposing end face cams 23 are different in phase from each other and at least partially overlap in the camshaft directions when the two adjacent cam elements are close to each other. Thus, the valve operating system (i.e., the engine) can be reduced in size even more in the camshaft directions.

Further, in this embodiment, the front and rear end face cams 23 of each of the cam elements $\mathbf{20}_1$ to $\mathbf{20}_4$ are formed such that their protrusion tip positions are different in phase in the rotational direction, and the longest length Lmax of the distance between the end face cams 23 in the camshaft directions in the same rotational phase is shorter than the distance Lpin between the switching members 32 at the respective actuated positions in the camshaft directions (the switching members 32 engaging with cam surfaces of the end face cams 23). Therefore, when moving one of the cam elements $\mathbf{20}_1$ to $\mathbf{20}_4$ to the other side in the camshaft directions to switch between the cams $\mathbf{22}_1$ and $\mathbf{22}_2$ by projecting, to the actuated position, the switching member 32 of one of the two switching devices which can engage with the front and rear end face cams 23 of the corresponding cam element, even if the switching member 32 of the other switching device is projected to the actuated position due to an operation defect or the like, the corresponding cam element does not become unrotatable by getting stuck between the switching members 32 projected to the actuated positions at both sides of the corresponding cam element. Thus, the rotation of the camshaft 2 is not interrupted.

The present invention is not limited to this embodiment, and may be substituted without deviating from the spirit and scope of the following claims.

For example, in the above embodiment, the first detent cam 45 of the first detent mechanism 40*a* is provided in the inner circumferential face of each of the cam elements $\mathbf{20}_1$ to $\mathbf{20}_4$ so that the first detent ball 43*a* pushes the first detent cam 45 from the camshaft 2 side by being elastically biased; however, the first detent cam 45 may be provided in the outer circumferential face of the camshaft 2 so that the first detent ball 43*a* pushes the first detent cam 45 from the one side of the corresponding cam element ($\mathbf{20}_1$ to $\mathbf{20}_4$) by being elastically biased. The second detent mechanism 40 may also be similar.

Moreover, in the above embodiment, the camshaft 2 on the exhaust side is described; however, the same or similar configuration may be applied to a camshaft on the intake side, and thus, the operations and effects described above can be obtained on the intake side.

Further, in the above embodiment, the valve operating system for switching between the cams $\mathbf{22}_1$ and $\mathbf{22}_2$ of each of the four cam elements $\mathbf{20}_1$ to $\mathbf{20}_4$ by using the six switching devices $\mathbf{30}_1$ to $\mathbf{30}_6$ is described; however, the present invention is not limited to this. For example, by providing two switching devices on both sides of each cam element (in a case of having four cam elements, total of eight switching devices are provided), the cams $\mathbf{22}_1$ and $\mathbf{22}_2$ of each cam element may be switched therebetween by the two switching devices. Alternatively, the third and fourth switching devices $\mathbf{30}_3$ and $\mathbf{30}_4$ of the above embodiment may be one common switching device, and the cams $\mathbf{22}_1$ and $\mathbf{22}_2$ of each of the four cam elements $\mathbf{20}_1$ to $\mathbf{20}_4$ may be switched therebetween by the five switching devices.

Moreover, in the above embodiment, in each of the cam elements $\mathbf{20}_1$ to $\mathbf{20}_4$, the lift of the first cam $\mathbf{22}_1$ is low and the lift of the second cam $\mathbf{22}_2$ is high; however, the high-and-low relationship between the lifts may be opposite. Moreover, the nose portion $b_1$ similar to the above embodiment may be provided in the first cam $\mathbf{22}_1$ while the second cam $\mathbf{22}_2$ is entirely formed only by the base circle a without providing the nose portion $b_2$ (zero lift of the nose portion $b_2$), and the valve may be not opened or closed when the second cam $\mathbf{22}_2$ is used. Thus, a reduced-cylinder operation can be performed when the engine is operated at a low load.

Furthermore, the present invention is not limited to the four-cylinder four-valve DOHC engine described in the above embodiment, and it is also applicable to various kinds of engines with different number of cylinders and valve operating types, such as inline six-cylinder engines, V-shaped multi-cylinder engines, four-cylinder two-valve DOHC engine, single-cylinder SOHC engines, and multi-cylinder SOHC engines.

Note that the above embodiment is merely an example, and the present invention should not be limited to the above embodiment. The scope of the present invention is defined by the following claims, and all of modifications and changes falling under the equivalent range of the claims are within the scope of the present invention.

The present invention is useful for valve operating systems for engines, each includes a cylindrical cam element and switches, by shifting the cam element in one of two camshaft directions, a cam for opening and closing a valve between two valve-opening-and-closing cams which are provided to the cam element coupled to a camshaft in its rotational direction and fitted to be able to shift (move) in the camshaft directions.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2 Camshaft
$\mathbf{20}_1$ to $\mathbf{20}_4$ Cam Element
$\mathbf{22}_1$, $\mathbf{22}_2$ Cam for Opening and Closing Valve
23 End Face Cam (First End Face Cam, Second End Face Cam)
32 Switching Member (First Switching Member, Second Switching Member)
40 Detent Mechanism
43*a* First Detent Ball (First Pushing Member)
43*b* Second Detent Ball (Second Pushing Member)
45 First Detent Cam
46 Second Detent Cam
51 First Groove
51*a* Inclining Portion of First Groove
52 Second Groove
52*a* Inclining Portion of Second Groove
53 Third Groove
53*a* Inclining Portion of Third Groove
54 Fourth Groove
54*a* Inclining Portion of Fourth Groove
55 First Top Portion
56 Second Top Portion

What is claimed is:

1. A valve operating system for an engine, shifting a cam element to one side or the other side in camshaft directions to switch a cam for opening and closing a valve between two valve-opening-and-closing cams, the system comprising:

a cylindrical cam element fitted onto a camshaft to be rotatably coupled in a rotational direction of the camshaft and shifted in the camshaft directions, and having two valve-opening-and-closing cams;

a first switching member for engaging with a first end face cam provided to one end face of the cam element on one side in the camshaft directions and shifting the cam element to the other side in the camshaft directions;

a second switching member for engaging with a second end face cam provided to the other end face of the cam element on the other side in the camshaft directions and shifting the cam element to the one side in the camshaft directions; and a pair of first and second detent mechanisms for holding the cam element at a first position when the cam element is shifted to the one side in the camshaft directions by the second switching member, and holding the cam element at a second position when the cam element is shifted to the other side in the camshaft directions by the first switching member, the second position being on the other side of the first position, wherein the first detent mechanism includes a first detent cam provided to one of the cam element and the camshaft, and a first pushing member pushed against the first detent cam by being elastically biased, wherein the second detent mechanism includes a second detent cam provided to one of the cam element and the camshaft, and a second pushing member pushed against the second detent cam by being elastically biased, wherein the first detent cam includes a first groove and a second groove aligned in the camshaft directions and into which the first pushing member fits, and a first top portion at the boundary between the first and second grooves, wherein the second detent cam includes a third groove and a fourth groove aligned in the camshaft directions and into which the second pushing member fits, and a second top portion at the boundary between the third and fourth grooves, wherein the first and second grooves have inclining portions extending from the first top portion toward bottoms of the first and second grooves while inclining with respect to the camshaft directions, respectively, wherein the third and fourth grooves have inclining portions extending from the second top portion toward bottoms of the third and fourth grooves while inclining with respect to the camshaft directions, respectively, wherein a relative moving distance for the first pushing member fitted into the first groove to cross over the first top portion with respect to the cam element in the camshaft directions is set longer than a relative moving distance for the first pushing member fitted into the second groove to cross over the first top portion with respect to the cam element in the camshaft directions, wherein a relative moving distance for the second pushing member fitted into the third groove to cross over the second top portion with respect to the cam element in the camshaft directions is set longer than a relative moving distance for the second pushing member fitted into the fourth groove to cross over the second top portion with respect to the cam element in the camshaft directions, wherein when the cam element is at the second position, the first pushing member is fitted into the second groove and the second pushing member is fitted into the third groove, and in a case of shifting the cam element from the second position to the one side in the camshaft directions, the first and second detent mechanisms assist this shifting in a manner that the first pushing member relatively moves to the first top portion side along the inclining portion of the second groove, the second pushing member relatively moves to the second top portion side along the inclining portion of the third groove, the first pushing member crosses over the first top portion while the second pushing member still moves along the second top portion, and the first pushing member pushes the inclining portion of the first groove after crossing over the first top portion, and wherein when the cam element is at the first position, the first pushing member is fitted into the first groove and the second pushing member is fitted into the fourth groove, and in a case of shifting the cam element from the first position to the other side in the camshaft directions, the first and second detent mechanisms assist this shifting in a manner that the first pushing member relatively moves to the first top portion side along the inclining portion of the first groove, the second pushing member relatively moves to the second top portion side along the inclining portion of the fourth groove, the second pushing member crosses over the second top portion while the first pushing member still moves along the first top portion, and the second pushing member pushes the inclining portion of the third groove after crossing over the second top portion.

2. The system of claim 1, wherein the first and second detent cams are formed symmetric to each other with respect to a plane passing through a center between the first and second top portions in the camshaft directions and extending perpendicular to the camshaft directions.

3. The system of claim 2, wherein the first switching member projects to an actuated position at which the first switching member engages with the first end face cam so as to shift the cam element to the other side in the camshaft directions, and retreats to a non-actuated position at which the first switching member is retreated from the actuated position, wherein the second switching member projects to an actuated position at which the second switching member engages with the second end face cam so as to shift the cam element to the one side in the camshaft directions, and retreats to a non-actuated position at which the second switching member is retreated from the actuated position, and wherein the first and second end face cams of the cam element are formed such that protrusion tip positions of the first and second end face cams are different in phase in the rotational direction and a longest distance between cam surfaces of the first and second end face cams in the camshaft directions in the same rotational phase is shorter than a distance between the first and second switching members at the respective actuated positions in the camshaft directions.

4. The system of claim 1, wherein the first switching member projects to an actuated position at which the first switching member engages with the first end face cam so as to shift the cam element to the other side in the camshaft directions, and retreats to a non-actuated position at which the first switching member is retreated from the actuated position, wherein the second switching member projects to an actuated position at which the second switching member engages with the second end face cam so as to shift the cam element to the one side in the camshaft directions, and retreats to a non-actuated position at which the second switching member is retreated from the actuated position, and wherein the first and second end face cams of the cam element are formed such that protrusion tip positions of the first and second end face cams are different in phase in the rotational direction and a longest distance between cam surfaces of the first and second end face cams in the camshaft directions in the same rotational phase is shorter than a distance between the first and second switching members at the respective actuated positions in the camshaft directions.

* * * * *